US008118415B2

(12) United States Patent
Kanbe et al.

(10) Patent No.: US 8,118,415 B2
(45) Date of Patent: Feb. 21, 2012

(54) INK CARTRIDGES AND INK SUPPLY SYSTEMS

(75) Inventors: Tomohiro Kanbe, Nagoya (JP); Shingo Hattori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 680 days.

(21) Appl. No.: 12/244,611

(22) Filed: Oct. 2, 2008

(65) Prior Publication Data

US 2009/0096849 A1 Apr. 16, 2009

(30) Foreign Application Priority Data

Oct. 15, 2007 (JP) ..... 2007-268351

(51) Int. Cl.
*B41J 2/175* (2006.01)

(52) U.S. Cl. ..... 347/86; 347/85; 347/87

(58) Field of Classification Search ..... 347/85–87
See application file for complete search history.

(56) References Cited

U.S. PATENT DOCUMENTS

| | | | | |
|---|---|---|---|---|
| 5,485,187 | A | 1/1996 | Okamura et al. | |
| 7,168,800 | B2 * | 1/2007 | Katayama | 347/86 |
| 2003/0007029 | A1 * | 1/2003 | Kotaki | 347/30 |
| 2004/0061748 | A1 * | 4/2004 | Kuwabara et al. | 347/85 |
| 2004/0090510 | A1 * | 5/2004 | Inoue et al. | 347/104 |
| 2005/0068349 | A1 * | 3/2005 | Matsumoto et al. | 347/7 |
| 2005/0109701 | A1 * | 5/2005 | Morse et al. | 210/703 |
| 2006/0244790 | A1 | 11/2006 | Umeda | |

FOREIGN PATENT DOCUMENTS

| | | | |
|---|---|---|---|
| JP | H05-138893 | A | 6/1993 |
| JP | H07-089081 | A | 4/1995 |
| JP | 2000-085141 | A | 3/2000 |
| JP | 2005-205779 | A | 8/2005 |
| JP | 2006-327186 | A | 12/2006 |

* cited by examiner

*Primary Examiner* — Ellen Kim
(74) *Attorney, Agent, or Firm* — Baker Botts L.L.P.

(57) ABSTRACT

An ink cartridge includes an ink tank which includes an ink chamber formed in an interior of the ink tank, and a first wall separating the interior of the ink tank and an exterior of the ink tank, in which the first wall has a first opening formed therethrough. The ink tank also includes a partition wall connected to the first wall. The partition wall defines a first chamber formed therein, and the first chamber is continuous with the first opening. Moreover, the ink tank includes a divider. The first chamber and the ink chamber are in fluid communication via the divider, and when ink flows through the divider from the first chamber to the ink chamber, the divider is configured to divide a first air bubble contained in the ink into a plurality of second air bubbles. Specifically, a size of the first air bubble is greater than a size of each of the plurality of second air bubbles. The ink cartridge also includes a pump configured to selectively force ink into and out of the interior of the ink tank.

14 Claims, 21 Drawing Sheets

INK CARTRIDGES AND INK SUPPLY SYSTEMS

CROSS-REFERENCE TO RELATED APPLICATION

The present application claims priority from Japanese Patent Application No. JP-2007-268351, which was filed on Oct. 15, 2007, the disclosure of which is incorporated herein by reference in its entirety.

BACKGROUND OF THE INVENTION

1. Field of the Invention

The present invention relates generally to ink cartridges and ink supply systems. In particular, the present invention is directed toward ink cartridges and ink supply systems in which a pump is used to cause ink flow.

2. Description of Related Art

A known inkjet printer has a print head configured to selectively eject ink from nozzles formed in the print head toward a sheet of paper to form an image on the sheet.

This known inkjet printer uses a replaceable ink cartridge having an ink tank configured to store ink therein, and ink is supplied from the ink tank to the print head via an ink path formed between the ink tank and the print head.

The ink cartridge has an ink supply opening for supplying ink from the interior of the ink tank to the exterior of the ink tank. The ink supply opening is sealed with a sealing member, such as rubber. When the ink cartridge is inserted into a mounting portion of the inkjet printer, an ink needle positioned at the mounting portion penetrates through the sealing member, and ink stored in the ink tank is supplied to the ink path via the ink needle.

When the ink cartridge is replaced with a new ink cartridge, air bubbles may enter the ink tank and the ink path. Moreover, when the ambient temperature varies, air dissolved in ink stored in the ink tank may transform into air bubbles. If such air bubbles enter the print head, the print head may fail to eject ink. Another known inkjet printer, such as the inkjet printer described in JP-A-2000-85141, has an ink supply system in which a sub ink tank, which is connected to a print head, and a main ink tank are in fluid communication with each other via an ink path, and a pump, which is configured to deliver ink in opposite directions, is provided in the ink path. The pump is driven for returning ink in the sub ink tank to the main ink tank, and for supplying ink in the main ink tank to the sub ink tank. This system allows air bubbles to be separated from ink in the main ink tank, and then ink without air bubbles is supplied to the sub ink tank.

When the ink cartridge is manufactured, minute impurities, such as dust, may enter the ink tank. When the impurities contained in ink reach the print head, the impurities may clog the nozzles and the print head may fail to eject ink. Impurities, such as dust, may be more difficult to remove from ink than air bubbles because some of impurities float on ink, some impurities settle at the bottom of the ink, and other impurities suspend in ink. In recent yeas, because consumer demands for higher resolution of printed images has risen, the diameter of nozzles has decreased. Consequently, the desirability to remove impurities of sizes which previously could be ignored is increasing.

SUMMARY OF THE INVENTION

Therefore, a need has arisen for ink cartridges and ink supply systems which overcome these and other shortcomings of the related art. A technical advantage of the present invention is that minute impurities are separated from ink stored in an ink tank.

According to an embodiment of the present invention, An ink cartridge comprises an ink tank which comprises an ink chamber formed in an interior of the ink tank, and a first wall separating the interior of the ink tank and an exterior of the ink tank, in which the first wall has a first opening formed therethrough. The ink tank also comprises a partition wall connected to the first wall. The partition wall defines a first chamber formed therein, and the first chamber is continuous with the first opening. Moreover, the ink tank comprises a divider. The first chamber and the ink chamber are in fluid communication via the divider, and when ink flows through the divider from the first chamber to the ink chamber, the divider is configured to divide a first air bubble contained in the ink into a plurality of second air bubbles. Specifically, a size of the first air bubble is greater than a size of each of the plurality of second air bubbles. The ink cartridge also comprises a pump configured to selectively force ink into and out of the interior of the ink tank.

According to another embodiment of the present invention, an ink supply system comprises an ink tank which comprises an ink chamber formed in an interior of the ink tank, and a first wall separating the interior of the ink tank and an exterior of the ink tank, in which the first wall has a first opening formed therethrough. The ink tank also comprises a partition wall connected to the first wall. The partition wall defines a first chamber formed therein, and the first chamber is continuous with the first opening. Moreover, the ink tank comprises a divider. The first chamber and the ink chamber are in fluid communication via the divider, and when ink flows through the divider from the first chamber to the ink chamber, the divider is configured to divide a first air bubble contained in the ink into a plurality of second air bubbles. Specifically, a size of the first air bubble is greater than a size of each of the plurality of second air bubbles. The ink cartridge also comprises a pump configured to selectively force ink into and out of the interior of the ink tank, and a tube configured to be in fluid communication with the first chamber via the first opening.

Other objects, features, and advantages of embodiments of the present invention will be apparent to persons of ordinary skill in the art from the following description of preferred embodiments with reference to the accompanying drawings.

BRIEF DESCRIPTION OF DRAWINGS

For a more complete understanding of the present invention, the needs satisfied thereby, and the objects, features, and advantages thereof, reference now is made to the following description taken in connection with the accompanying drawings.

FIG. 8 is a partial, cross-sectional view of the ink cartridge of FIG. 7 taken along a line VIII-VIII of.

DETAILED DESCRIPTION OF EMBODIMENTS

Embodiments of the present invention and their features and technical advantages may be understood by referring to FIGS. 1-21(C), like numerals being used for like corresponding portions in the various drawings.

Figure 1:
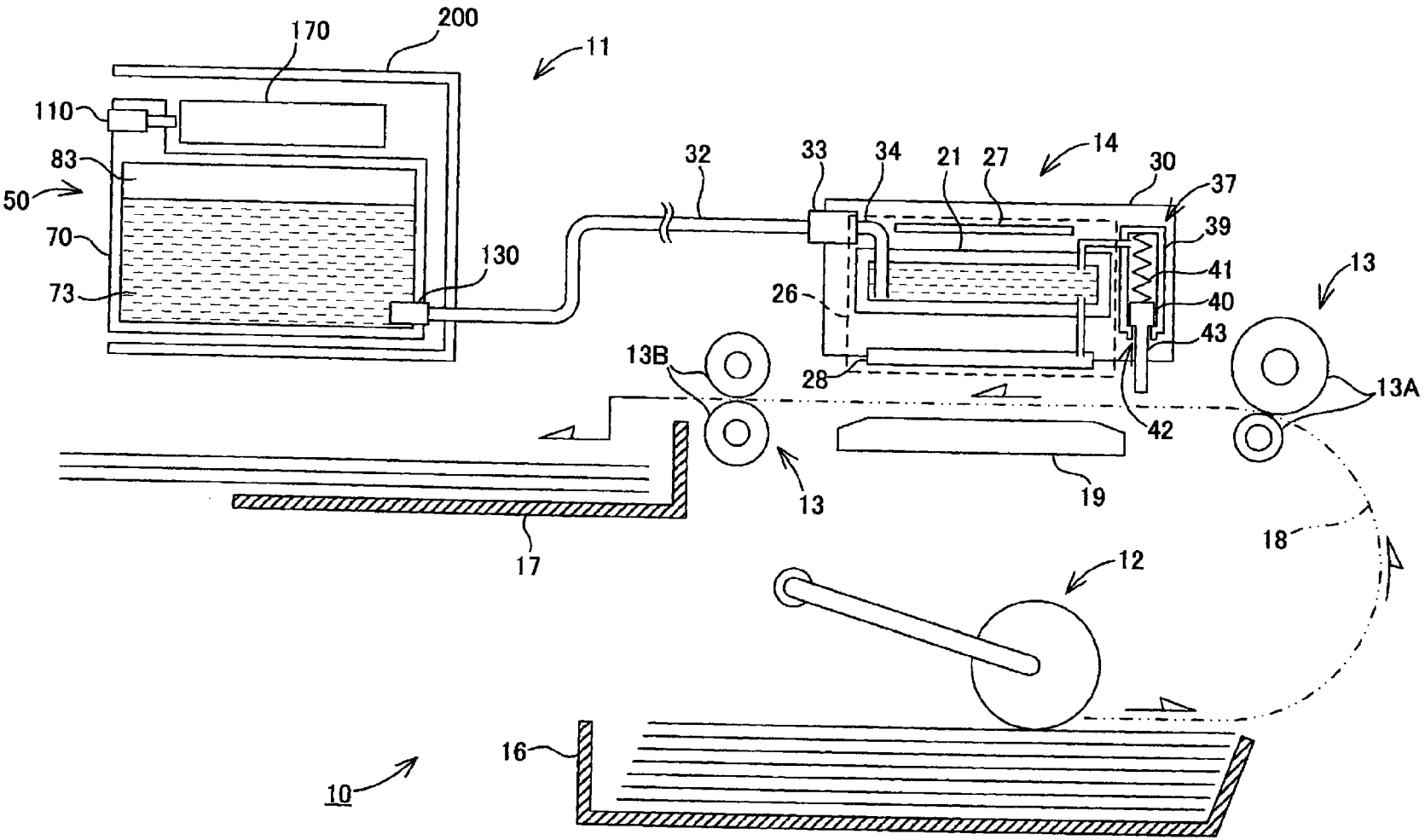
FIG. 1 is a cross-sectional, pattern diagram of an inkjet printer, according to an embodiment of the present invention.

Referring to FIG. 1, an inkjet recording device 10 may be configured to record images, e.g., color images or monochrome images, on a recording medium e.g., a sheet of paper, using black ink or a plurality of, e.g., five, colors of inks, e.g. cyan ink, magenta ink, yellow ink, dye-based black ink, and pigment-based black ink. Inkjet recording device 10 may comprise a paper feed device 12, a convey device 13, a recording unit 14, an ink supply system 11, a paper tray 16, and a discharge tray 17. Paper tray 16 may be configured to accommodate recording media, e.g., sheets of paper, and the recording media may be fed by paper feed device 12 to a paper path 18. Paper path 18 may have a sideways "U" shape, and convey device 13 may be provided along paper path 18. Convey device 13 may comprise a pair of convey rollers 13A, a pair of discharge rollers 13B, and a platen 19. Convey rollers 13A may be positioned on the upstream side of recording unit 14 in paper path 18, and discharge rollers 13B may be positioned on the downstream side of recording unit 14 in paper path 18.

Convey rollers 13A may be configured to convey the sheet fed by paper feed device 12 to platen 19. Recording unit 14 may be positioned directly above platen 19, and may be configured to record images on the sheet passing over platen 19. Discharge rollers 13B may be configured to contact, position, and start conveying the sheet when the leading edge of the sheet reaches discharge rollers 13B. Both convey rollers 13A and discharge rollers 13B may be configured to convey the sheet until the trailing edge of the sheet passes between convey rollers 13A. After the sheet has passed between convey rollers 13A, the sheet may be conveyed by discharge rollers 13B but not convey rollers 13A. Discharge tray 17 may be positioned at the downstream end of paper path 18. Discharge rollers 13B may be configured to discharge the sheet, on which the image has been recorded, to discharge tray 17.

Recording unit 14 may comprise a carriage 30, at least one sub ink tank 21, a head control board 27, and a recording head 26. Carriage 30 may be supported by rails configured to allow carriage 30 to slide, and may be configured to slide in a back-and-forth direction when inkjet recording device 10 is positioned, as shown in FIG. 1. Sub ink tank 21 may be configured to store ink to be supplied to recording head 26. A plurality of, e.g., five, sub ink tanks 21 may be provided, corresponding to the five colors of inks, respectively.

Recording head 26 may comprise a plurality of nozzles 28, through which ink may be ejected toward the sheet of paper based on image signals input to head control board 27. Inkjet recording device 10 may comprise a main controller, which may be configured to control inkjet recording device 10, and the main controller may output image signals to head control board 27.

Carriage 30 may comprise a side face having at least one joint 33 provided thereon. At least one flexible tube 32 may be connected to the at least one joint 33. A plurality of e.g., five, tubes 32, and a plurality of, e.g., five, joints 33 may be provided, each corresponding to the five colors of inks, respectively. A path 34 may be provided in carriage 30, and may extend from joint 33 to the bottom of sub ink tank 21.

A valve mechanism 37 may be provided in carriage 30, and valve mechanism 37 may comprise a cylinder 39, which may be in fluid communication with one or more of sub ink tank 21, a coil spring 41, and a piston 40. Coil spring 41 and piston 40 may be accommodated in cylinder 39. Cylinder 39 may comprise a bottom wall, and an opening 42 may be formed through the bottom wall of cylinder 39. Coil spring 41 may be compressed, and may bias piston 40 toward opening 42 to close opening 42. A rod 43 may extend from piston 40 to the exterior of cylinder 39 via opening 42.

When a force is applied to rod 43 in a direction opposite the direction of the biasing force of coil spring 41, piston 40 may be configured to move within cylinder 39 against the biasing force of coil spring 41, and opening 42 may be opened. The interior of sub ink tank 21 may be configured to be in fluid communication with the atmosphere via cylinder 39 and opening 42 when opening 42 is opened. When ink flows into or out of sub ink tank 21 via tube 32, opening 42 may be opened. When inkjet recording device 10 is in a waiting or non-recording state, e.g., a state in which inkjet recording device 10 does not perform recording, opening 42 may be closed to prevent ink evaporation.

Ink supply system 11 may comprise a cartridge mounting portion 200, at least one ink cartridge 50, at least one flexible tube 32, and at least one sub ink tank 21. Cartridge mounting portion 200 may be configured to be detachably receive at least one ink cartridge 50 therein.

Ink cartridge 50 may comprise an ink tank for storing ink, e.g., main ink tank 70. Main ink tank 70 and sub ink tank 21 may be configured to be in fluid communication via tube 32. A plurality of, e.g., five, tubes 32, may be connected to a plurality of, e.g., five, main ink tanks 70 of a plurality of, e.g., five, ink cartridges 50 and a plurality of, e.g., five, sub ink tanks 21, respectively. Ink may flow between main ink tank 70 and sub ink tank 21 bi-directionally via tube 32. Tube 32 may comprise at least one flexible synthetic resin, and may be configured to bend and to follow the movement of carriage 30 when carriage 30 reciprocates.

When ink in sub ink tank 21 and tube 32 is returned to main ink tank 70, air bubbles, which may have been trapped in sub ink tank 21 and tube 32, may be transferred to main ink tank 30 along with ink, and may be separated from ink inside main ink tank 30. After that, ink from which air bubbles have been separated may be supplied from main ink tank 70 to sub ink tank 21. Consequently, ink in sub ink tank 21 may be replaced with ink in main ink tank 70, and ink in sub ink tank 21 and ink in main ink tank 70 may be mixed. Thus, the viscosity of ink may be equalized by the mixture.

Figure 2A:
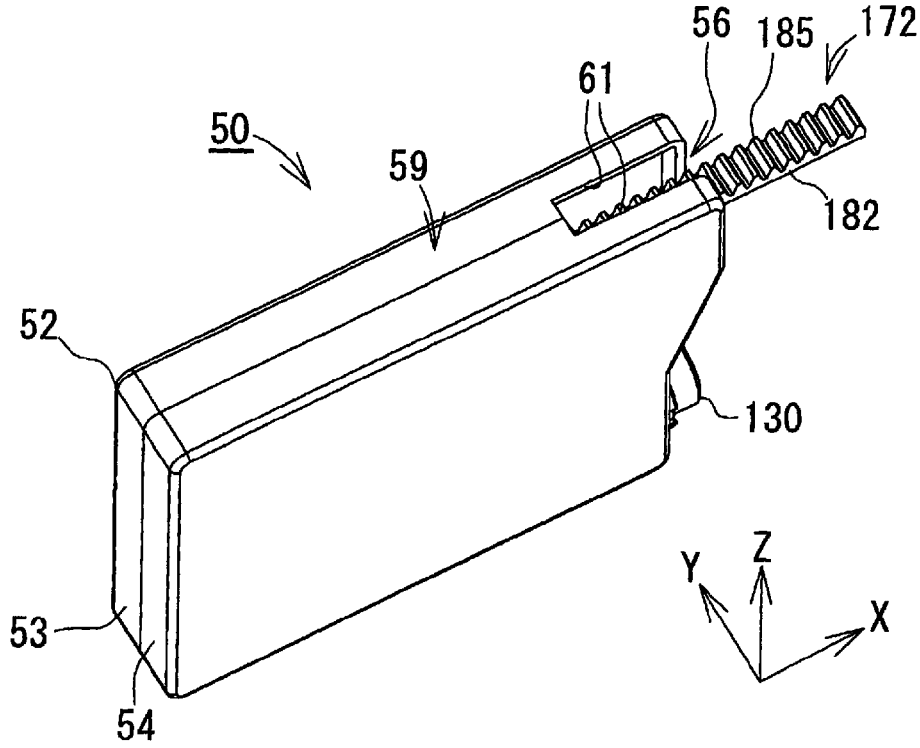
FIG. 2(A) is a perspective view of an ink cartridge, according to an embodiment of the present invention, in which a case of the ink cartridge is assembled.
Figure 2B:
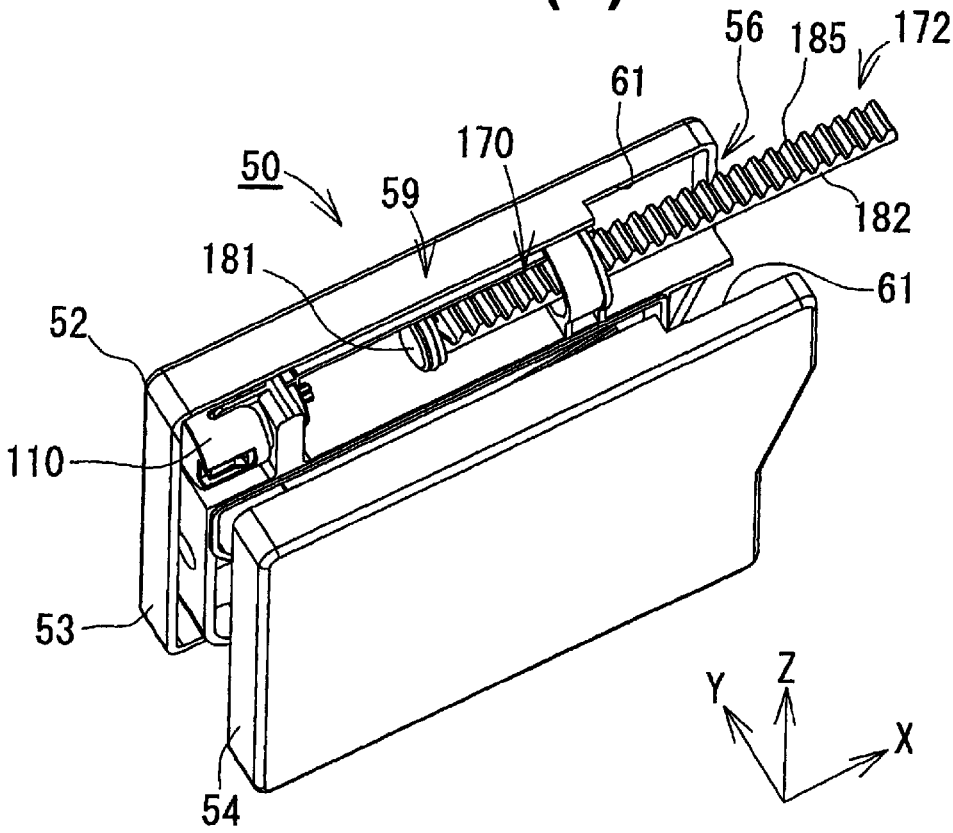
FIG. 2(B) is a perspective view of the ink cartridge in which the ink cartridge is not assembled.
Figure 3:
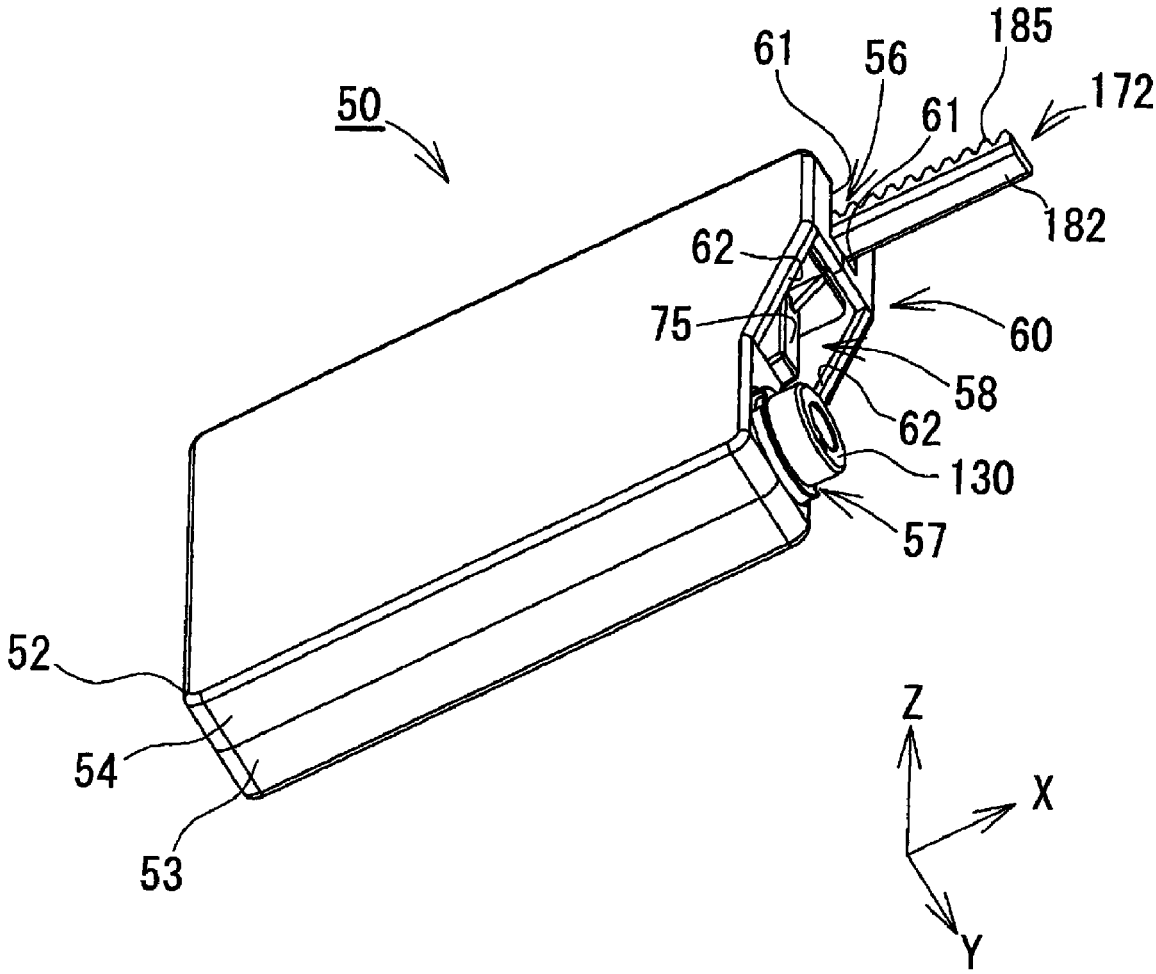
FIG. 3 is a perspective view of the ink cartridge of FIG. 2(A), in which the ink cartridge is shown at an angle different than the angle at which the ink cartridge is shown in FIG. 2(A).

Referring to FIGS. 2(A)-3, ink cartridge 50 may comprise a case 52, which may have a rectangular parallelepiped shape, having a width in a Y-axis direction when positioned, as shown in FIGS. 2(A)-3, a height in a Z-axis direction when positioned, as shown in FIGS. 2(A)-3, and a depth in an X-axis direction when positioned, as shown in FIGS. 2(A)-3. The height may be greater than the width, and the depth may be greater than the height. An X-axis direction may be parallel with a direction in which ink cartridge 50 is mounted into cartridge mounting portion 200. An X-Y plane which is defined by an X axis and a Y axis may be a horizontal plane. The X-axis, the Y-axis, and the Z-axis may be perpendicular to each other.

Case 52 may comprise a first case member 53 and a second case member 54. Case 52 may be configured to be selectively disassembled into first case member 53 and second case member 54 along the X-axis direction and the Z-axis direction when case 52 is positioned, as shown in FIG. 2(B). The shape of first case member 53 may be substantially the same as the shape of second case member 54. Each of first case member 53 and second case member 54 may comprise at least one synthetic resin, and may be manufactured by injection molding.

Case 52 may comprise a top face 59 and a front face 60. Front face 60 has a first end and a second end, and top face 59 may be connected to the first end of front face 60. Opening 56 may be formed through top face 59, may extend to front face 60, and may be defined by cut-out portions 61 formed in first case member 53 and second case member 54, respectively. A portion of a rod 182 may be positioned in opening 56, and rod 182 may be configured to extend from front face 60. Opening 57 may be formed through front face 60, adjacent to the second end of front face 60. Opening 57 may be defined by a pair of semicircular cut-out portions formed in first case member 53 and second case member 54, respectively. An ink supply valve mechanism 130 may extend from the interior of case 52 to the exterior of case 52 through opening 57. Opening 58 may be formed through front face 60 between opening 56 and opening 57, and may be defined by rectangular cut-out portions 62 formed in first case member 53 and second case member 54, respectively. A detection portion 75 may be positioned in the interior of case 52, and may be exposed to the exterior of case 52 through opening 58.

Figure 4:
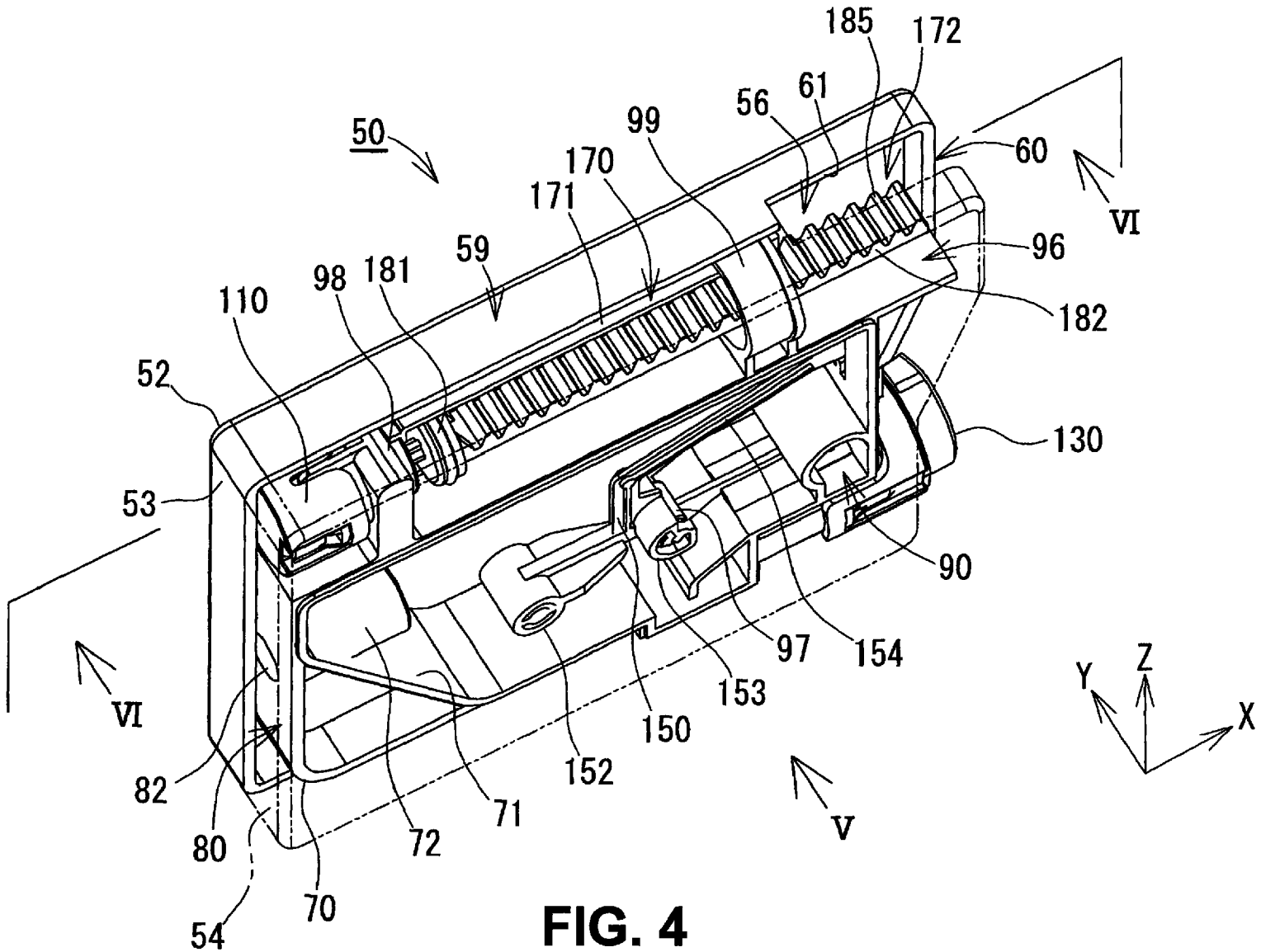
FIG. 4 is a perspective view of the ink cartridge of FIG. 2(A), in which a second case member of the ink cartridge is depicted by a double-dashed line in order to show the interior of the ink cartridge.
Figure 5:
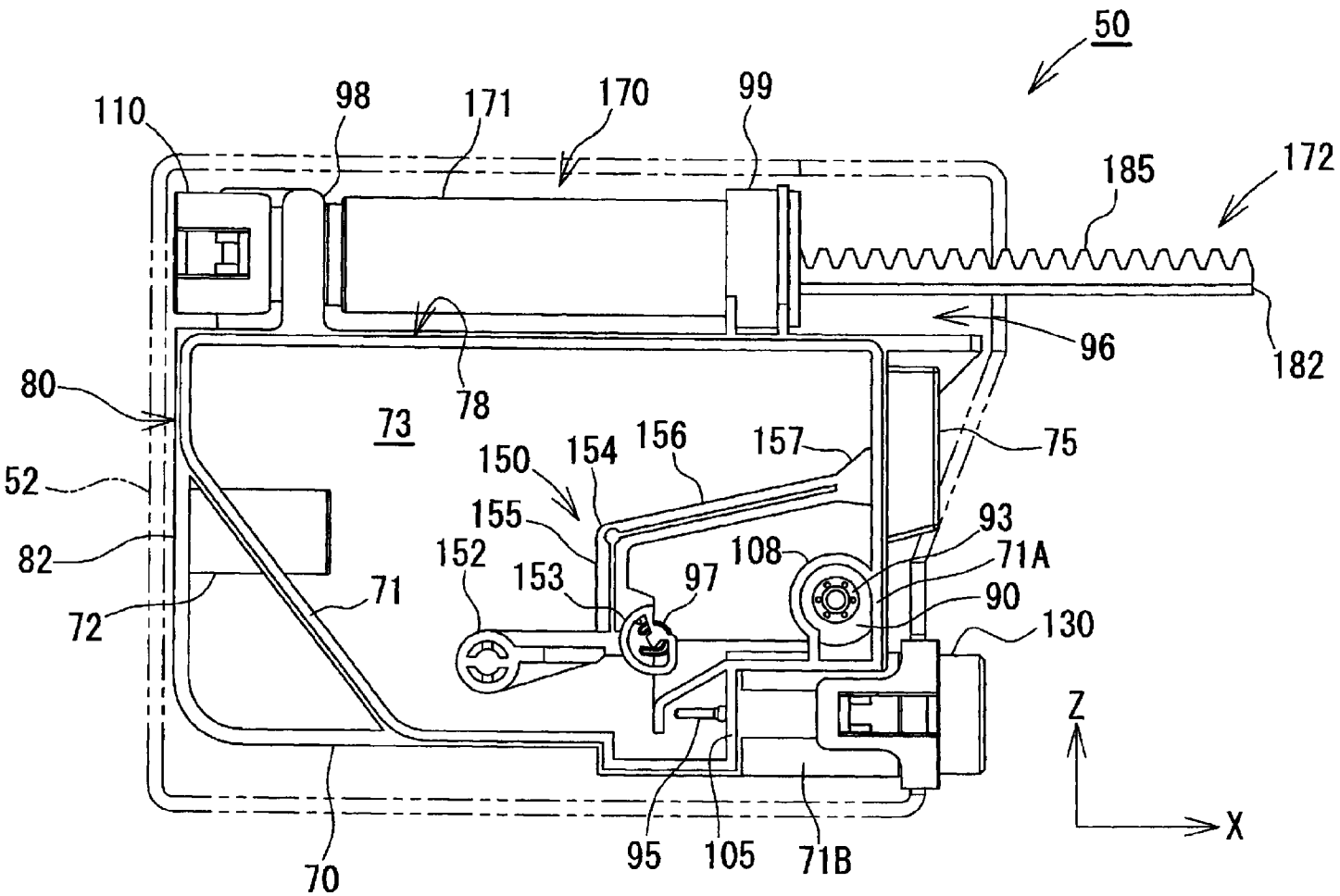
FIG. 5 is a side view of the ink cartridge of FIG. 4 viewed in a direction indicated by an arrow V in FIG. 4, in which the case is depicted by a double-dashed line in order to show the interior of the ink cartridge.
Figure 6:
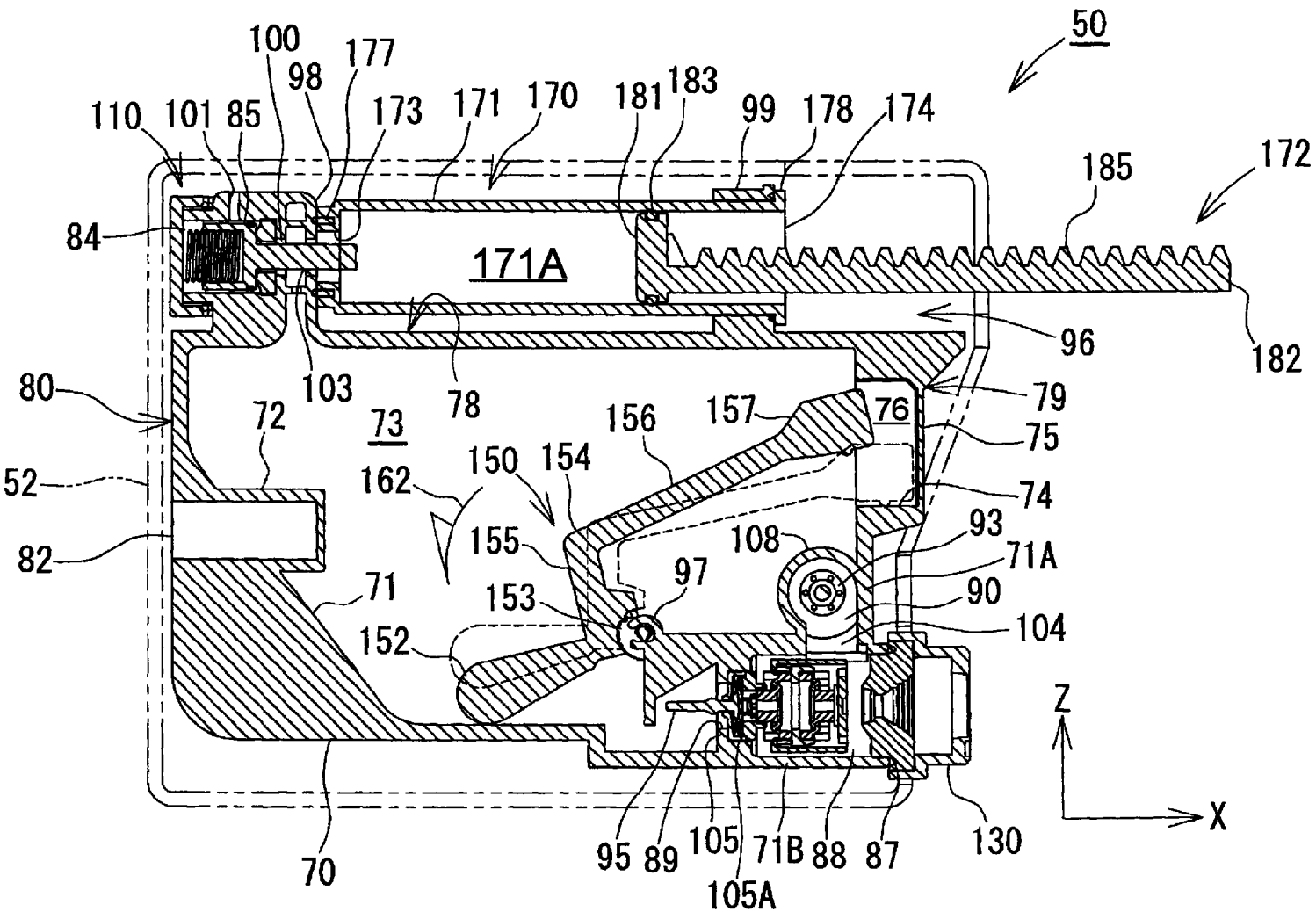
FIG. 6 is a cross-sectional view of the ink cartridge of FIG. 4 taken along a line VI-VI.

Referring to FIGS. 4-6, ink cartridge 50 may comprise main ink tank 70, a pump 170, an air communication valve mechanism 110, and ink supply valve mechanism 130. At least a portion of each of main ink tank 70, pump 170, air communication valve mechanism 110, and ink supply valve mechanism 130 may be positioned in case 52. Each of main ink tank 70, pump 170, air communication valve mechanism 110, and ink supply valve mechanism 130 may comprise at least one synthetic resin.

Figure 8:
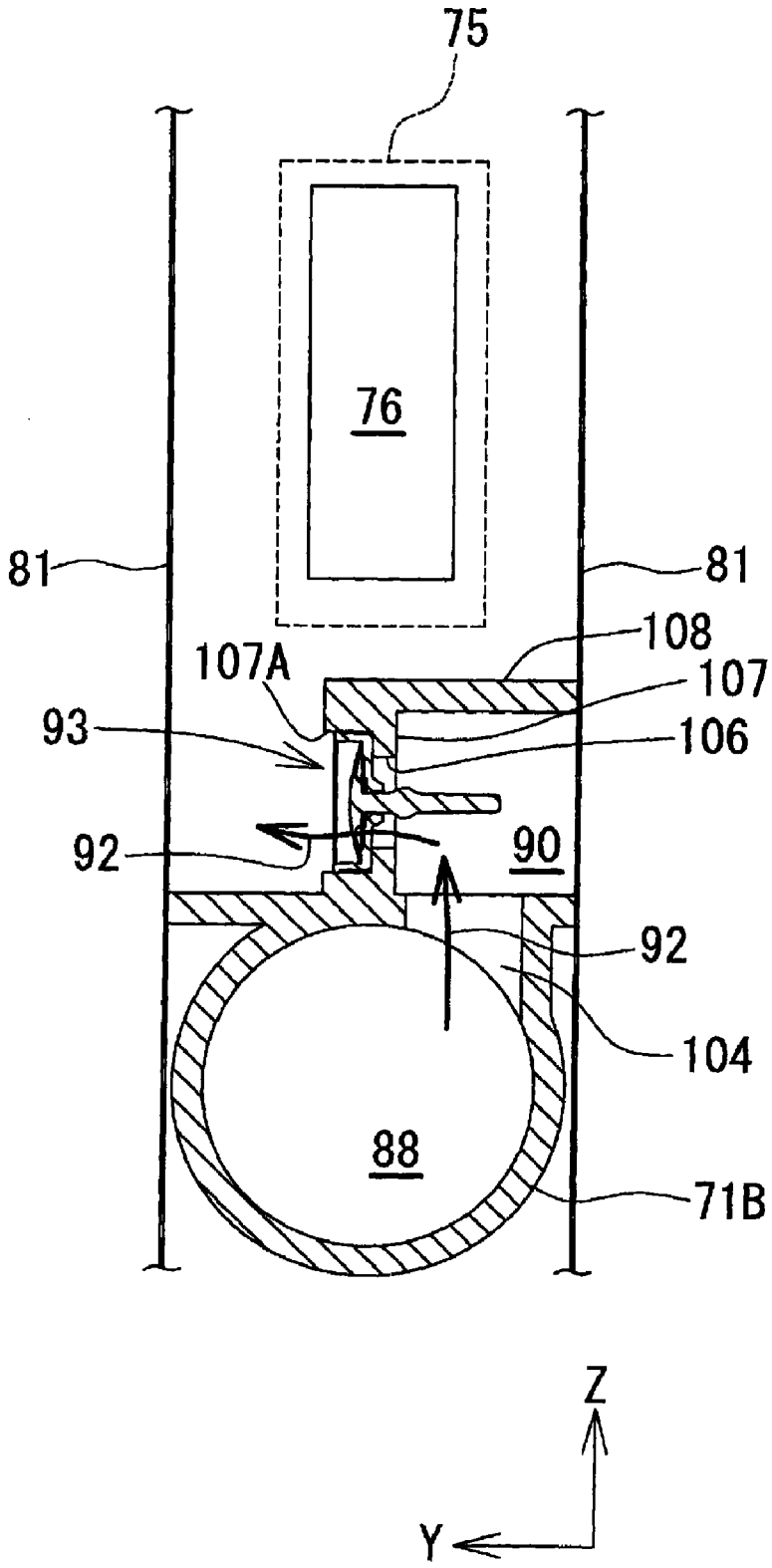

Main ink tank 70 may be substantially enclosed in case 52 and may have a width in the Y-axis direction, a height in the Z-axis direction, a depth in the X-axis direction, when main ink tank 70 is positioned, as shown in FIG. 4. The height of main ink tank 70 may be greater than the width of main ink tank 70, and the depth of main ink tank 70 may be greater than the height of main ink tank 70. Main ink tank 70 may comprise a translucent, e.g., transparent or semi-transparent, frame 71, and a pair of translucent, e.g., transparent or semi-transparent, films 81, as shown in FIG. 8, welded to both side faces of frame 71, respectively. Frame 71 and films 81 may define an ink chamber 73 therein for storing ink. Films 81 are not shown in FIGS. 4-6

Figure 7:
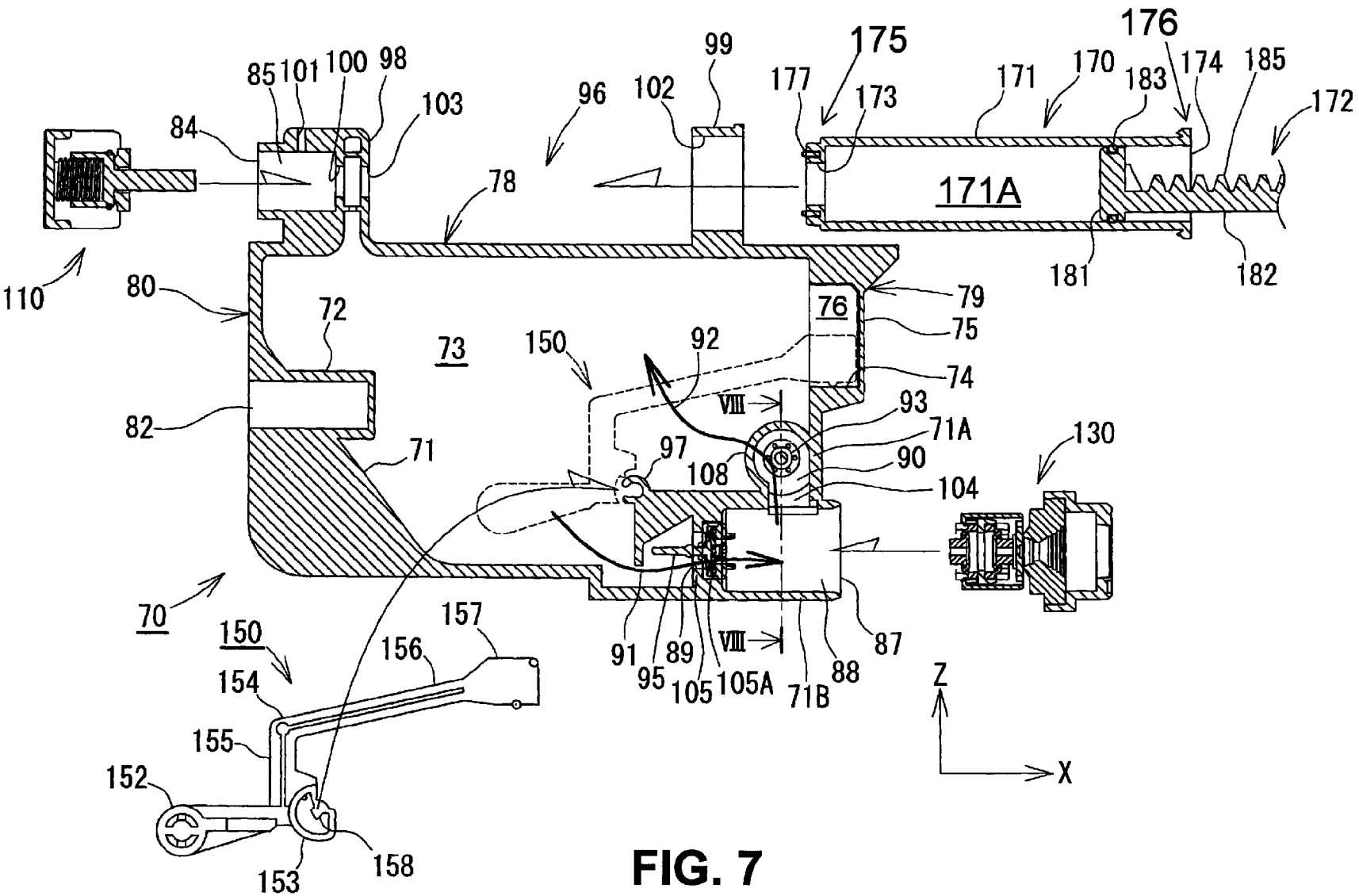
FIG. 7 is an exploded, cross-sectional view of the ink cartridge of FIG. 6 in which the case is omitted.
Figure 11:
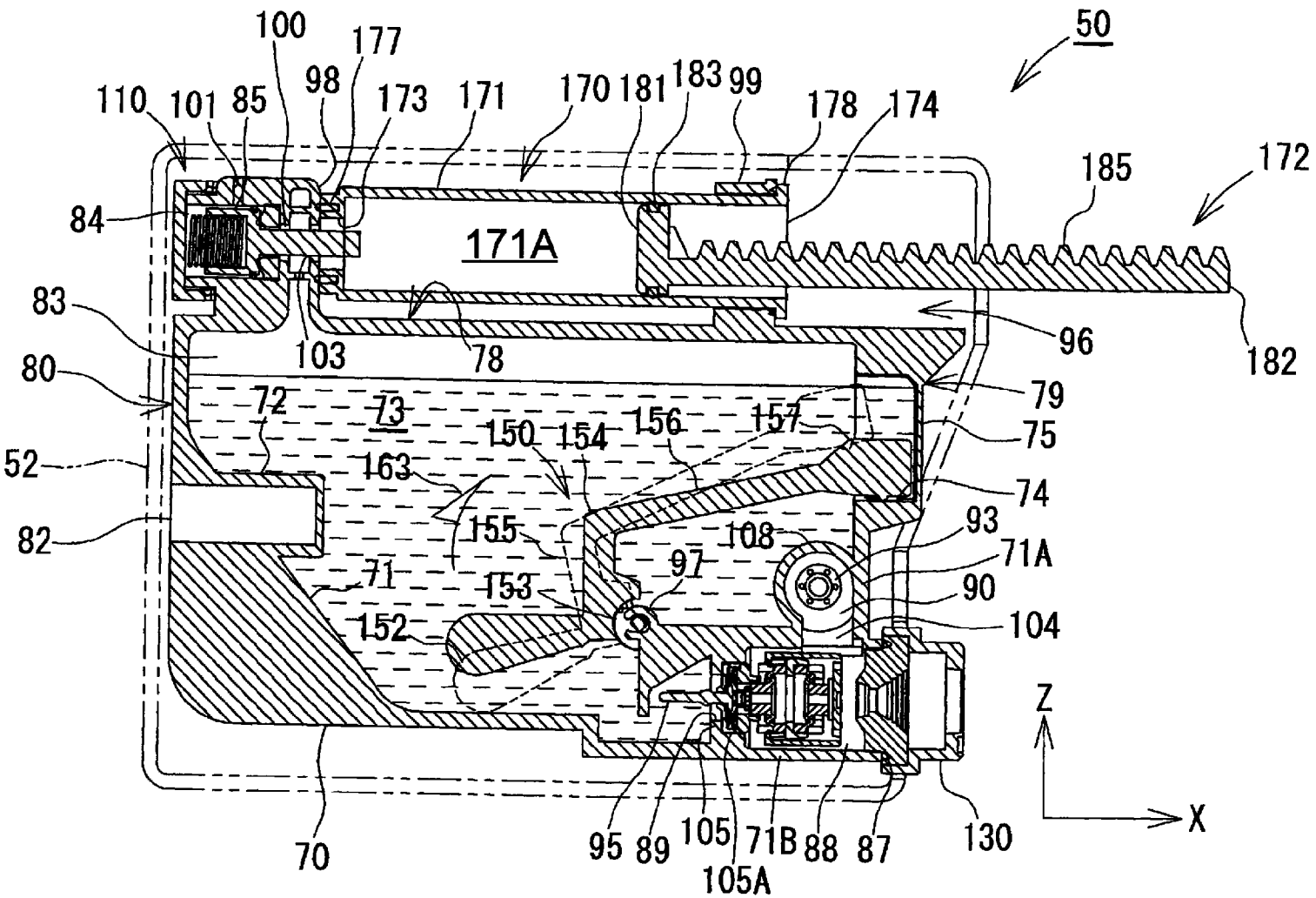
FIG. 11 is a cross-sectional view of the ink cartridge of FIG. 6, in which a predetermined amount of ink is stored in an ink chamber.

Referring to FIGS. 4-7, main tank 70 may comprise a cylindrical ink fill portion 72, and ink fill portion 72 may be integrally formed with frame 71. An ink fill opening 82 may be formed through a rear face 80 of main tank 70. Ink fill portion 72 may extend from ink fill opening 82 toward ink chamber 73 in the X-axis direction when main ink tank 70 is positioned, as shown in FIGS. 4-7. Ink chamber 73 may be configured to be filled with a predetermined amount of ink via ink fill opening 82 and ink fill portion 72. The predetermined amount of ink may be about 80% of a maximum capacity of ink chamber 73. Ink chamber 73 may comprise an upper portion positioned closer to air communication valve mechanism 110 than to ink supply valve mechanism 130, and a lower portion positioned closer to ink supply valve mechanism 130 than to air communication valve mechanism 110. After ink chamber 73 is filled with ink, a rubber plug may be press-fitted in ink fill portion 72 from ink fill opening 82. Ink chamber 73 may be hermetically closed after ink chamber 73 is filled with ink because ink supply valve mechanism 130 and air communication valve mechanism 110 also may be closed. Referring to FIG. 11, an air layer 83, which contacts ink in ink chamber 73, may be formed at the upper portion of ink chamber 73 after ink chamber 73 is filled with ink Referring to FIGS. 6, 7, 11, and 12, rear face 80 may comprise an upper end and a lower end, and a circular opening 84 may be formed through rear face 80 of main ink tank 70, adjacent to the upper end of rear face 80. A cylindrical valve accommodating chamber 85 may be formed in main ink tank 70, and valve accommodating chamber 85 may extend from opening 84 in the X-axis direction when main ink tank 70 is positioned, as shown in FIGS. 6, 7, 11, and 12. A piston 116 of a valve 113, a coil spring 112, and a valve seat 114 may be accommodated within valve accommodating chamber 85. Valve accommodating chamber 85 may comprise an end opposite opening 84 in the X-axis direction when main ink tank 70 is positioned, as shown in FIGS. 6, 7, and 11. An opening 100 may be formed at the end of valve accommodating chamber 85, and opening 100 may be in fluid communication with the upper portion of ink chamber 73. In particular, opening 100 may be in fluid communication with air layer 83 formed at the upper portion of ink chamber 73. A portion of a rod 117 of valve 113 may be positioned in opening 100. The diameter of opening 100 may be greater than the outer diameter of rod 117. Therefore, rod 117 may not close opening 100, and air communication between valve accommodating chamber 85 and ink chamber 73 may not be prevented. A cross section of rod 117 taken along a plane perpendicular to the X-axis direction may have a cross shape. Valley portions 117B of rod 117 may be configured to allow air to pass therethrough. Valve accommodating chamber 85 may comprise a cylindrical wall surface extending from opening 84 to the end of valve accommodating chamber 85. An opening 101 may be formed in the wall surface of valve accommodating chamber 85, and may be in fluid communication with the atmosphere. Air communication valve mechanism 110 may be configured to alternately allow and prevent fluid communication between opening 100 and opening 101.

Referring to FIGS. 6-8, and 15, main ink tank 70 may comprise side wall 71A defining a front face 79 of main ink tank 70, and separating the interior of main ink tank 70 and the exterior of main ink tank 70. Side wall 71A may comprise an upper end and a lower end, and a circular opening 87 may be formed through side wall 71A adjacent to the lower end of side wall 71A.

Main ink tank 70 may comprise a partition wall connected to side wall 71A, and the partition wall defines a first chamber formed therein. The first chamber is continuous with opening 87. The partition wall may comprise a cylindrical wall 71B extending from side wall 71A, and the first chamber may comprise a cylindrical valve accommodating chamber 88 defined by cylindrical wall 71B. Valve accommodating chamber 88 may extend from opening 87 in the X-axis direction when main ink tank 70 is positioned, as shown in FIGS. 6-8, toward ink chamber 73. A valve 133 and a biasing member, e.g., a spring unit 134 shown in FIG. 15, may be accommodated within valve accommodating chamber 88.

Cylindrical wall 71B also may comprise an end wall 105, which may define an end of valve accommodating chamber 88 opposite opening 87 in the X-axis direction when main ink tank 70 is positioned, as shown in FIGS. 6-8. An opening 89 may be formed through end wall 105, and opening 89 may be continuous with ink chamber 73.

An opening 104 may be formed through cylindrical wall 71B above valve accommodating chamber 88 and adjacent to side wall 71A, and may be positioned above opening 89 and opening 87.

The partition wall also may comprise a substantially cylindrical side wall 108 and an end wall 107, both of which may be continuous with side wall 71A. The first chamber also may comprise a buffer chamber 90 defined by side wall 108 and end wall 107. Buffer chamber 90 may be positioned above valve accommodating chamber 88, e.g., directly above opening 104. Buffer chamber 90 may extend in the widthwise direction of main ink tank 70, i.e., in the Y-axis direction in FIG. 8. Side wall 108 may extend from a widthwise end of frame 71 to the widthwise center of frame 71. An end of side wall 108 at the widthwise center of frame 71 may be connected to end wall 107.

Opening 104 may be continuous with buffer chamber 90. Valve accommodating chamber 88 may be in fluid communication with ink chamber 73 via opening 104 and buffer chamber 90. The fluctuation of ink flow from opening 87 into main ink tank 70 may be buffered in buffer chamber 90, and air bubbles flowing into main ink tank 70 with ink and air bubbles remaining in valve accommodating chamber 88 may be temporarily collected in buffer chamber 90.

A recessed portion 105A may be formed in a face of end wall 105, and may face valve accommodating chamber 88. A check valve 95 may be positioned in recessed portion 105A. Opening 89 may be continuous with recessed portion 105A.

Check valve 95 may be configured to selectively open opening 89, such that check valve 95 allows ink to flow from ink chamber 73 to the valve accommodating chamber 88 through opening 89 when the pressure in ink chamber 73 is greater than the pressure in valve accommodating chamber 88, and to selectively close opening 89 when the pressure in ink chamber 73 is less than the pressure in valve accommodating chamber 88. A flow path 91 may be formed from ink chamber 73 to valve accommodating chamber 88 in main ink tank 70, as shown in FIG. 7. Flow path 91 may extend from the lower portion of the chamber 73 via the opening 89 to valve accommodating chamber 88.

Referring to FIG. 8, a recessed portion 107A may be formed in a face of end wall 107, and may face ink chamber 73. A check valve 93 may be positioned in recessed portion 107A. An opening 106 may be formed through end wall 107 in the widthwise direction, and may be continuous with recessed portion 107A.

Check valve 93 may be configured to selectively open opening 106, such that check valve 93 allows ink to flow from buffer chamber 90 to ink chamber 73 through opening 106 when the pressure in ink chamber 73 is less than the pressure in valve accommodating chamber 88, and to selectively close opening 106 when the pressure in ink chamber 73 is greater than the pressure in valve accommodating chamber 88. A flow path 92 may be formed from valve accommodating chamber 88 to ink chamber 73 via buffer chamber 90 in main ink tank 70.

Referring to FIG. 7, main tank 70 may comprise an upper face 78, and a space 96 may be formed at upper face 78 to position pump 170 therein. A pump seat 98 may be positioned on a wall defining the end of valve accommodating chamber 85. A pump seat 99 may be positioned on upper face 78 adjacent to front face 79. Pump seats 98 and 99 may be formed integrally with frame 71.

Pump 170 may be attached to main ink tank 70 at pump seats 98 and 99. Pump 170 may comprise a cylindrical tube 171. A cylindrical opening 102 may be formed through pump seat 99 in the X-axis direction, as shown in FIG. 7. The diameter of an opening 102 may be slightly greater than the outer diameter of cylindrical tube 171. Cylindrical tube 171 may comprise a front end 176 and a rear end 175 opposite front end 176. Cylindrical tube 171 may be inserted through opening 102, and rear end 175 may be attached to pump seat 98. Front end 176 of cylindrical tube 171 may be attached to pump seat 99. Cylindrical tube 171 may have an inner surface defining an inner space 171A. Pump seat 98 may have an opening 103 formed therethrough, and inner space 171A and ink chamber 73 may be in fluid communication via opening 103. In another embodiment, pump 170 may comprise a square-pillar tube instead of cylindrical tube 171. In yet another embodiment, pump 170 may comprise a tube having any other shape, as long as the tube comprises a hollow body with two ends opposite each other.

Referring to FIGS. 5-7, main ink tank 70 may comprise detection portion 75 extending from front face 79 of main ink tank 70 away from ink chamber 73 in the X-axis direction. Detection portion 75 may be integrally formed with frame 71, and detection portion 75 may comprise the same material as frame 71, e.g., at least one translucent, e.g., transparent or semi-transparent, synthetic resin. Detection portion 75 may be configured to allow light emitted from an optical sensor 203 to pass through.

Referring again to FIGS. 6-8, detection portion 75 may have an inner space 76 formed therein. Inner space 76 may be in fluid communication with ink chamber 73. A sensor arm 150 may comprise a light blocking portion 157, at least a portion of which may be configured to move in and out of inner space 76 based on an amount of ink in ink chamber 73. At least a portion of light blocking portion 157 may be configured to contact a support wall 74, which bounds the bottom of inner space 76, when a portion of light blocking portion 157 enters inner space 76, thus holding light blocking portion 157 at the position. At least a portion of light blocking portion 157 may be configured to be positioned at a particular position once it exits inner space 76, as shown in FIG. 6.

Main ink tank 70 may comprise a support portion 97 which may be formed integrally with frame 71 and may be configured to pivotally support sensor arm 150 and to grasp a shaft 158 of sensor arm 150.

Figure 9:
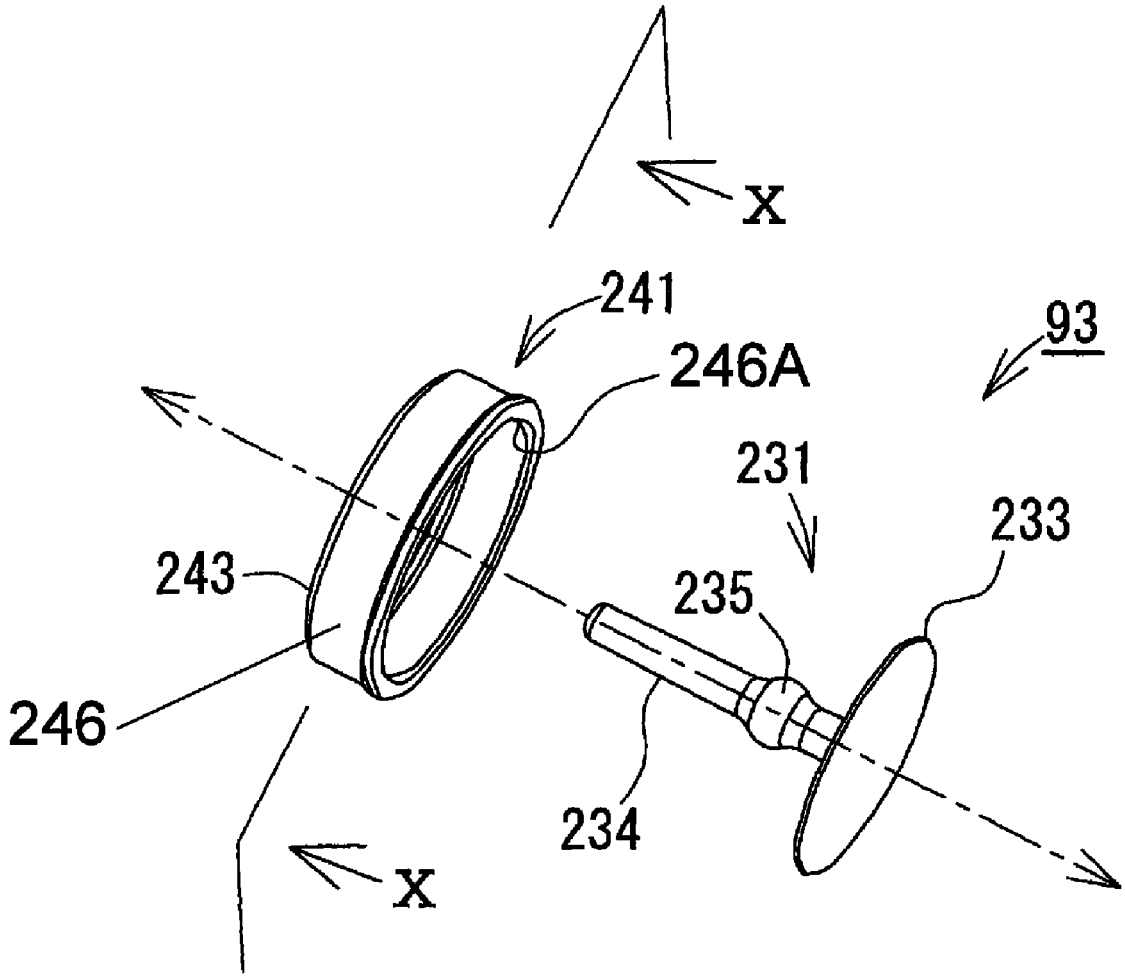
FIG. 9 is an exploded, perspective view of a check valve.

Referring to FIGS. 9 and 10, check valve 93 is described. Check valve 93 may have substantially the same structure as check valve 95, except that the size and the number of openings 244 formed through a valve seat 241 may be different.

Check valve 93 may comprise a valve member 231 and valve seat 241 for accommodating valve member 231. Valve member 231 may be manufactured by injection-molding silicon rubber, and valve seat 241 may be manufactured by injection-molding polypropylene.

Valve member 231 may have an umbrella shape, and may comprise a disc portion 233, and a cylindrical shaft portion 234 extending from disc portion 233. Disc portion 233 may have a thin, round shape. Shaft portion 234 may extend from a substantially center of disc portion 233 in a direction perpendicular to a surface of disc portion 233. Shaft portion 234 may comprise a thick portion 235, the diameter of which is greater than the diameter of the remaining portions of shaft portion 234. Thick portion 235 may be separated from disc portion 233 by a predetermined distance. Thick portion 235 may function as a stopper for limiting the stroke of valve member 231 when valve member 231 is assembled to valve seat 241.

Figure 10A:
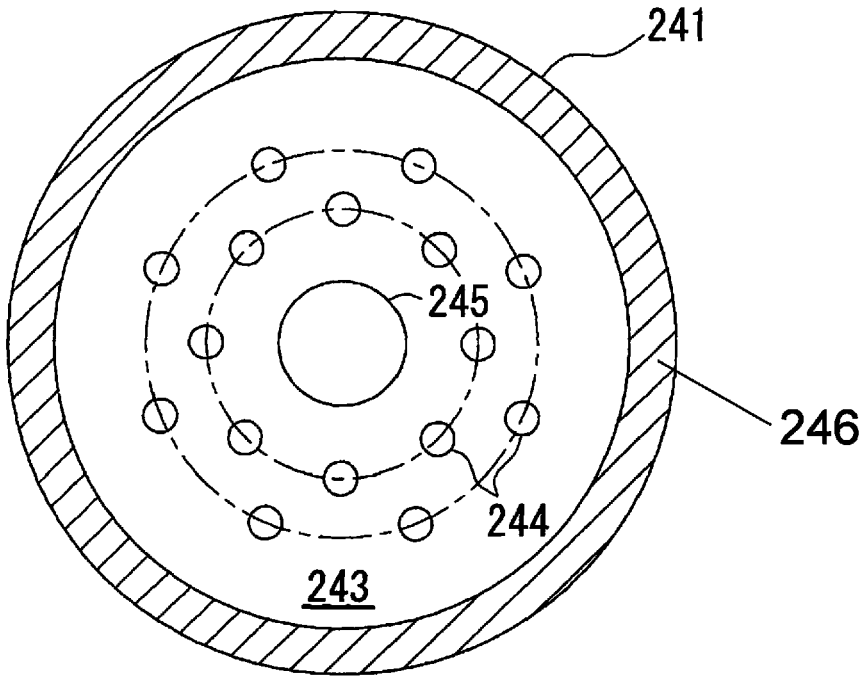
FIG. 10(A) is a cross-sectional view of the check valve of FIG. 9 taken along a line X-X.

Valve seat 241 may comprise a divider, e.g., a circular bottom wall 243 and a cylindrical side wall 246 extending from the outer edge of bottom wall 243 in a direction perpendicular to bottom wall 243. Side wall 246 may have a cylindrical inner opening 246A formed therein, and the diameter of inner opening 246A is greater than the outer diameter of disc portion 233 of valve member 231. Therefore, valve seat 241 may be configured to accommodate disc portion 233. Referring to FIG. 8, valve seat 241 may be fitted into recessed portion 107A while bottom wall 243 contacts the bottom of recessed portion 107A. Referring to FIG. 10(A), bottom wall 243 may have at least one opening, e.g., a plurality of openings 244, and an opening 245 formed therethrough. Ink may pass through openings 244, and shaft portion 234 of valve member 231 may be inserted through opening 245. In this embodiment, opening 245 may be formed through the center of bottom wall 243, and openings 244 may be positioned on concentric circles around opening 245. The position or the number of openings 244 may be changed based on the flow rate of ink through openings 244.

When shaft portion 234 of valve member 231 is inserted into opening 245, thick portion 235 may come into contact with a portion of bottom wall 243 defining opening 245. When shaft portion 234 is further inserted, thick portion 235 may pass through opening 245 while bending and deforming the portion of bottom wall 243 defining opening 245. As such, check valve 93 may be assembled. Disc portion 233 may selectively come into contact with bottom wall 243 to close openings 244, and separate from bottom wall 243 to open openings 244, based on the pressure differential between ink chamber 73 and buffer chamber 90. More specifically, check valve 93 may selectively allow ink to flow from buffer chamber 90 to ink chamber 73 through openings 244 while disc portion 233 is separated from bottom wall 243, and prevent ink from flowing from ink chamber 73 to buffer chamber 90 while disc portion 233 contacts bottom wall 243.

Check valve 95 may have substantially the same structure as check valve 93 except that check valve 95 may have openings 254 formed therethrough instead of opening 244. Therefore, only the differences between check valve 95 and check valve 93 are discussed with respect to check valve 95.

Figure 10B:
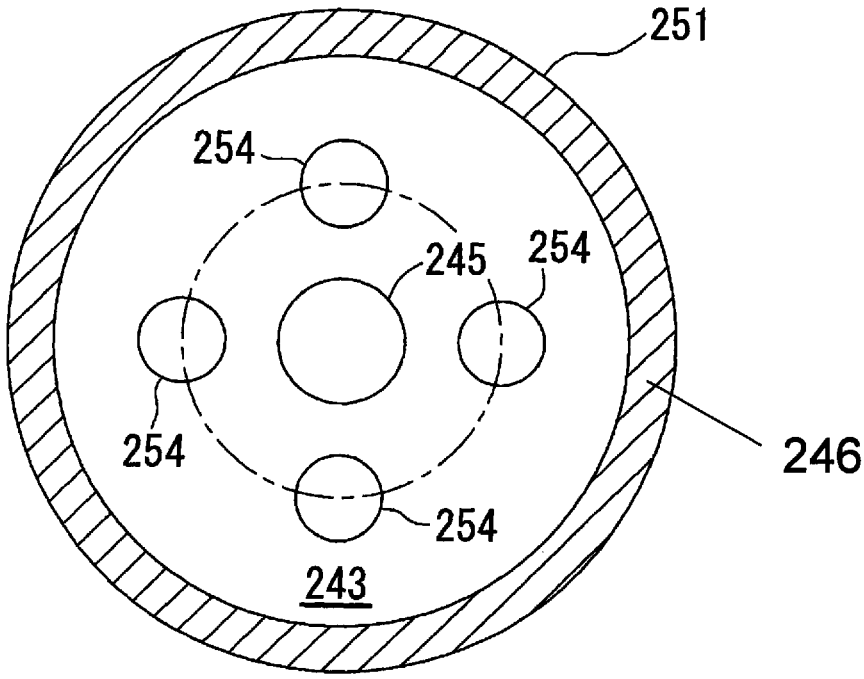
FIG. 10(B) is a cross-sectional view of another check valve in which the cross section of FIG. 10(B) corresponds to the cross section of FIG. 10(A).

Referring to FIG. 10(B), bottom wall 243 of valve seat 251 of check valve 95 may have at least one opening, e.g., a plurality of openings 254, formed therethrough. Openings 254 may be positioned on a circle around opening 245. In this embodiment, the diameter of each of openings 254 may be greater than the diameter of each of openings 244 of valve seat 241. Therefore, the flow resistance of openings 254 may be less than the flow resistance of openings 244. Disc portion 233 selectively may come into contact with bottom wall 243 to close openings 254, and separate from bottom wall 243 to open openings 254, based on the pressure differential between ink chamber 73 and valve accommodating chamber 88. More specifically, check valve 95 may selectively allow ink to flow from ink chamber 73 to valve accommodating chamber 88 through openings 254 while disc portion 233 is separated from bottom wall 243, and prevent ink from flowing from valve accommodating chamber 88 to ink chamber 73 while disc portion 233 contacts bottom wall 243.

Figure 16:
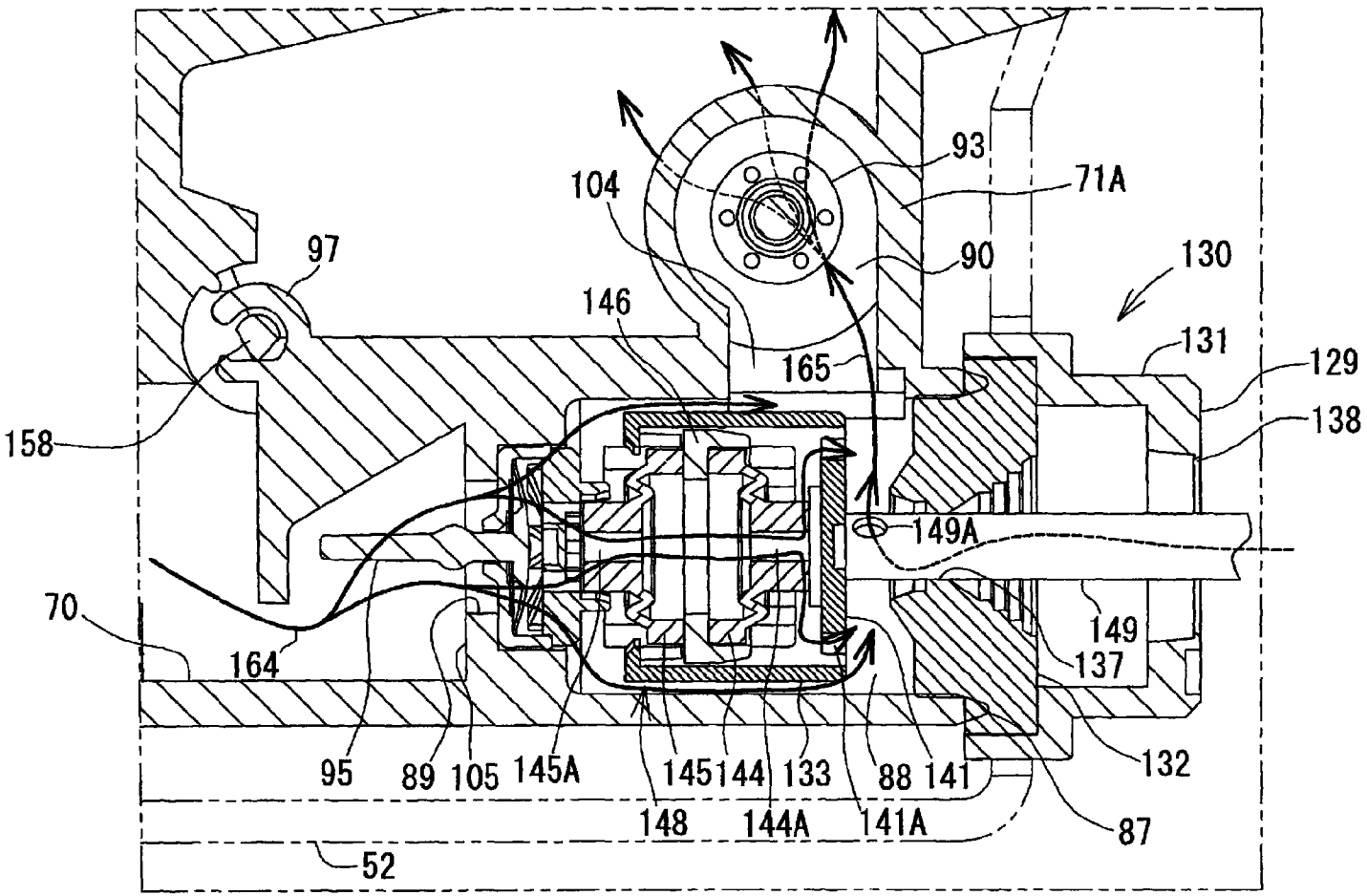
FIG. 16 is a partial, enlarged, cross-sectional view of the ink supply valve mechanism of FIG. 15.
Figure 17:
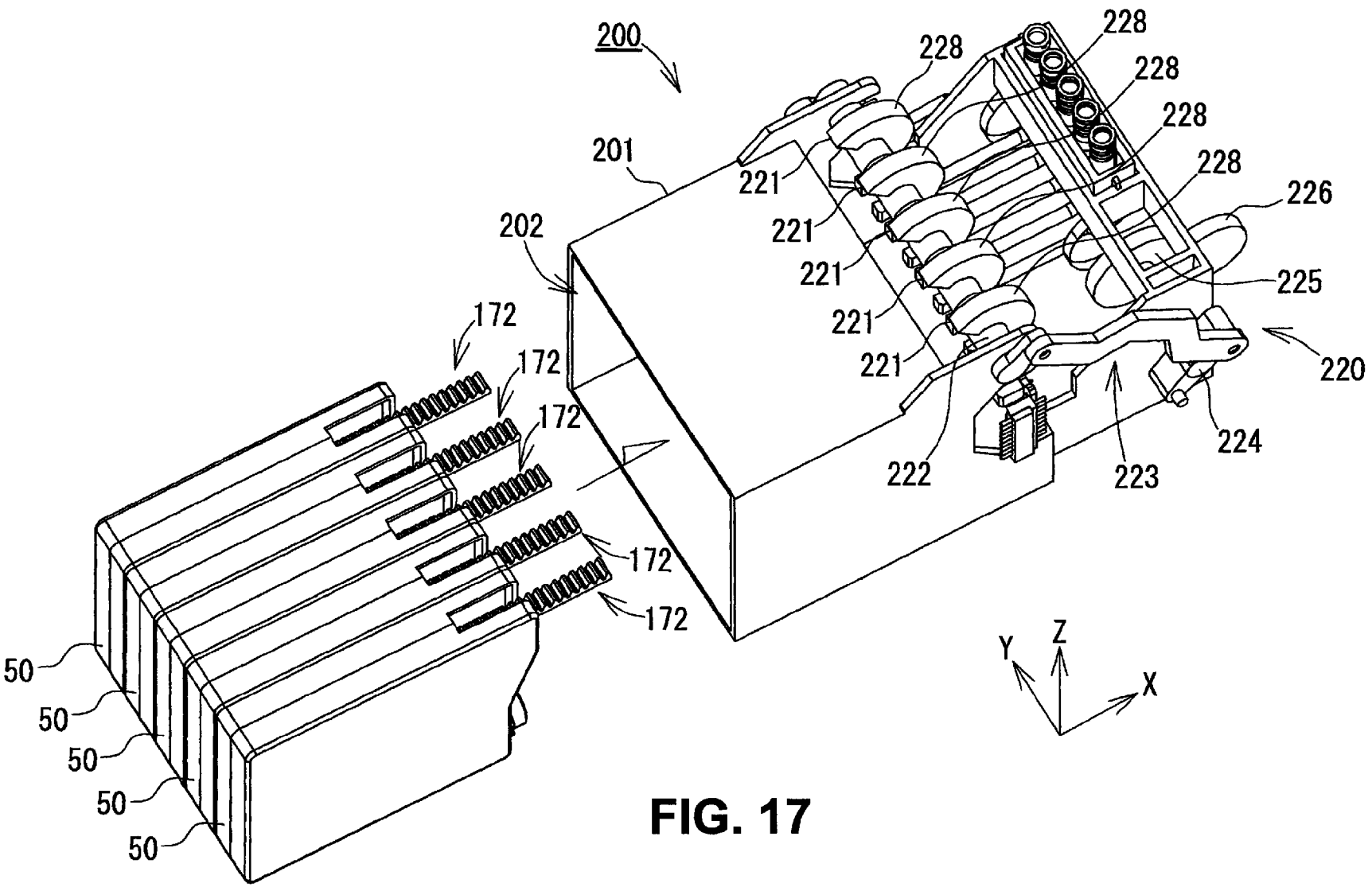
FIG. 17 is a perspective view of a cartridge mounting portion, in which the ink cartridges are not mounted to the cartridge mounting portion.
Figure 18:
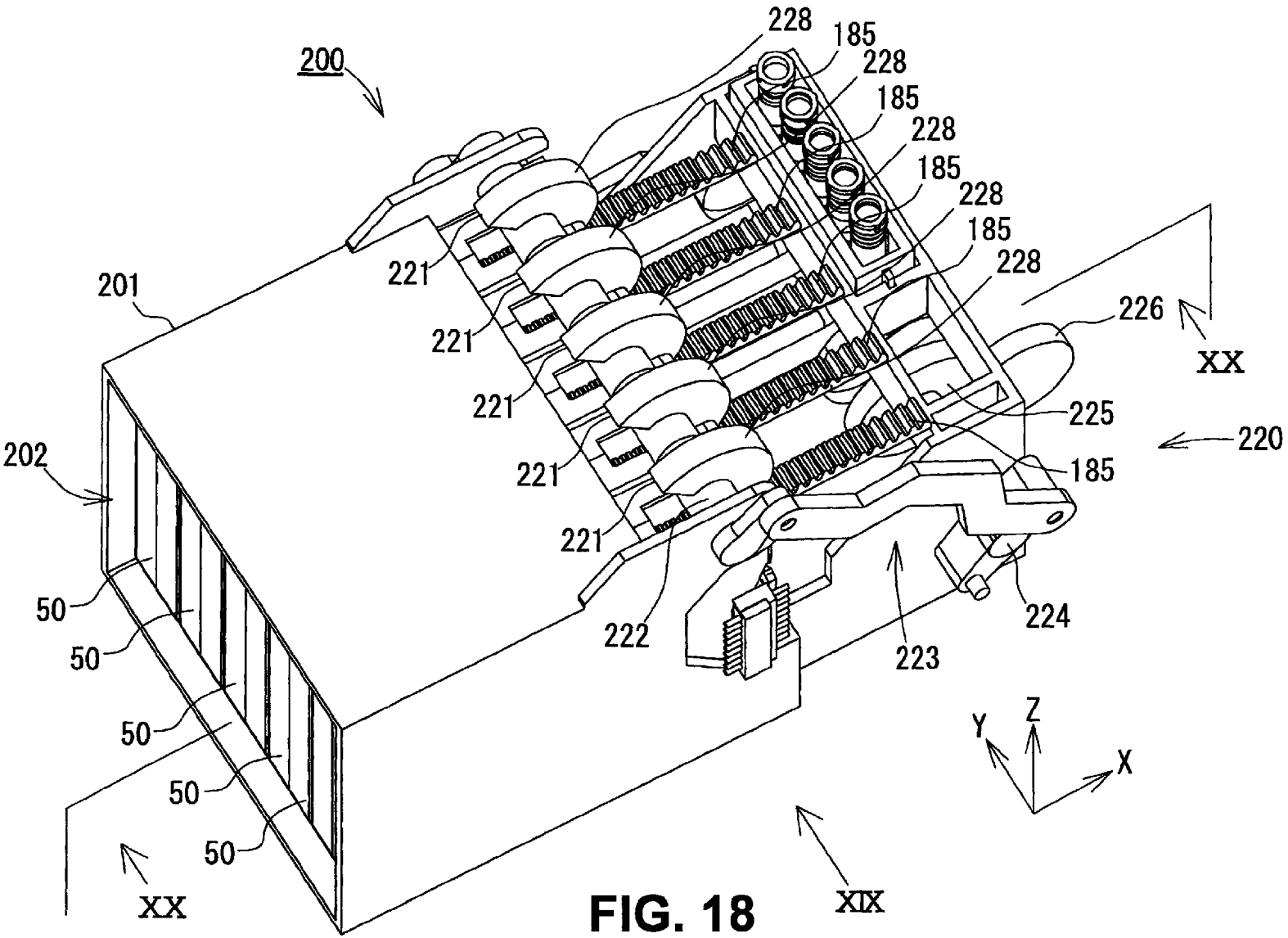
FIG. 18 is a perspective view of the cartridge mounting portion of FIG. 17, in which the ink cartridges are mounted to the cartridge mounting portion.
Figure 19:
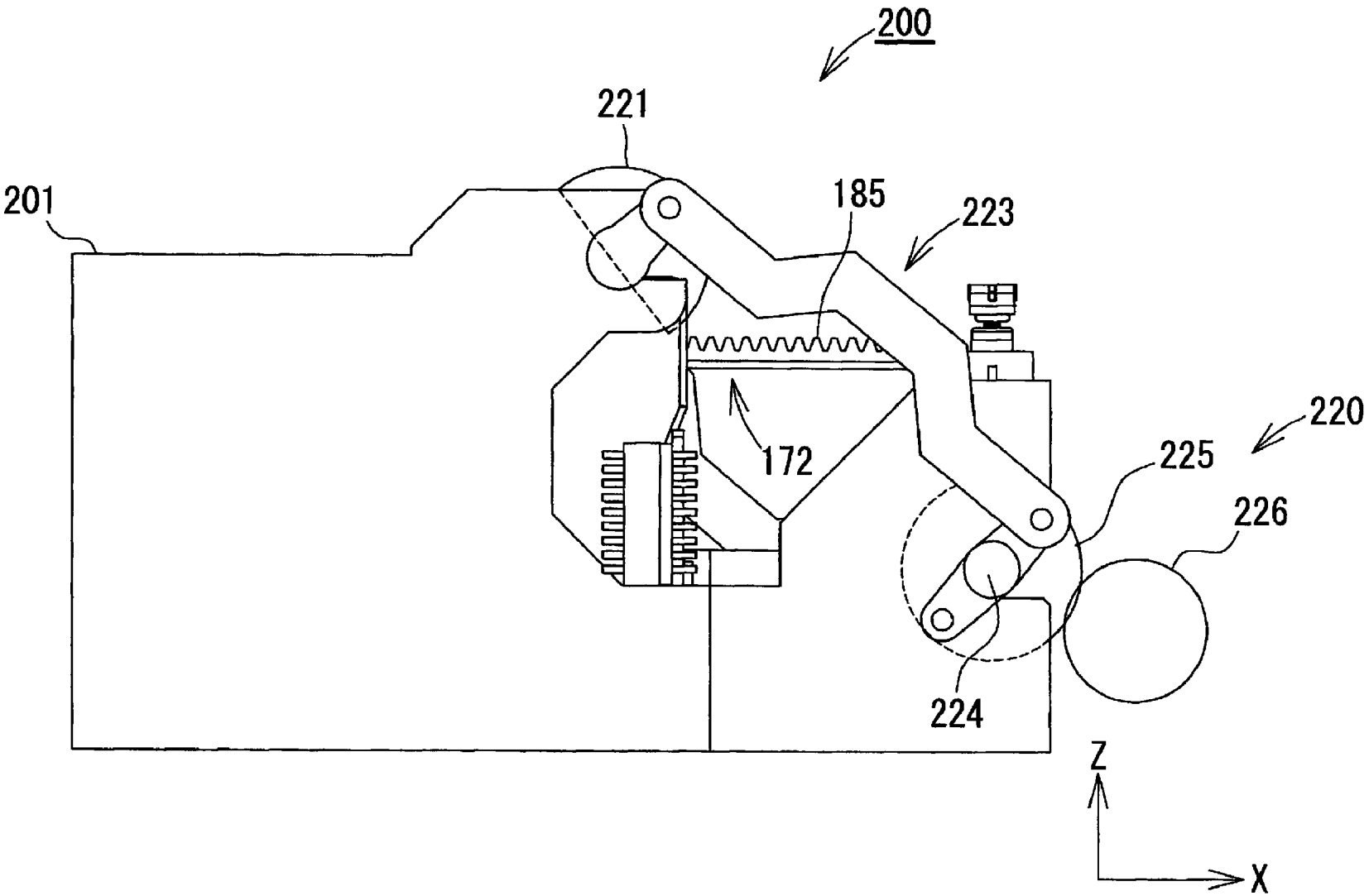
FIG. 19 is a side view of the cartridge mounting portion of FIG. 18 as viewed from a direction indicated by an arrow XIX.
Figure 20:
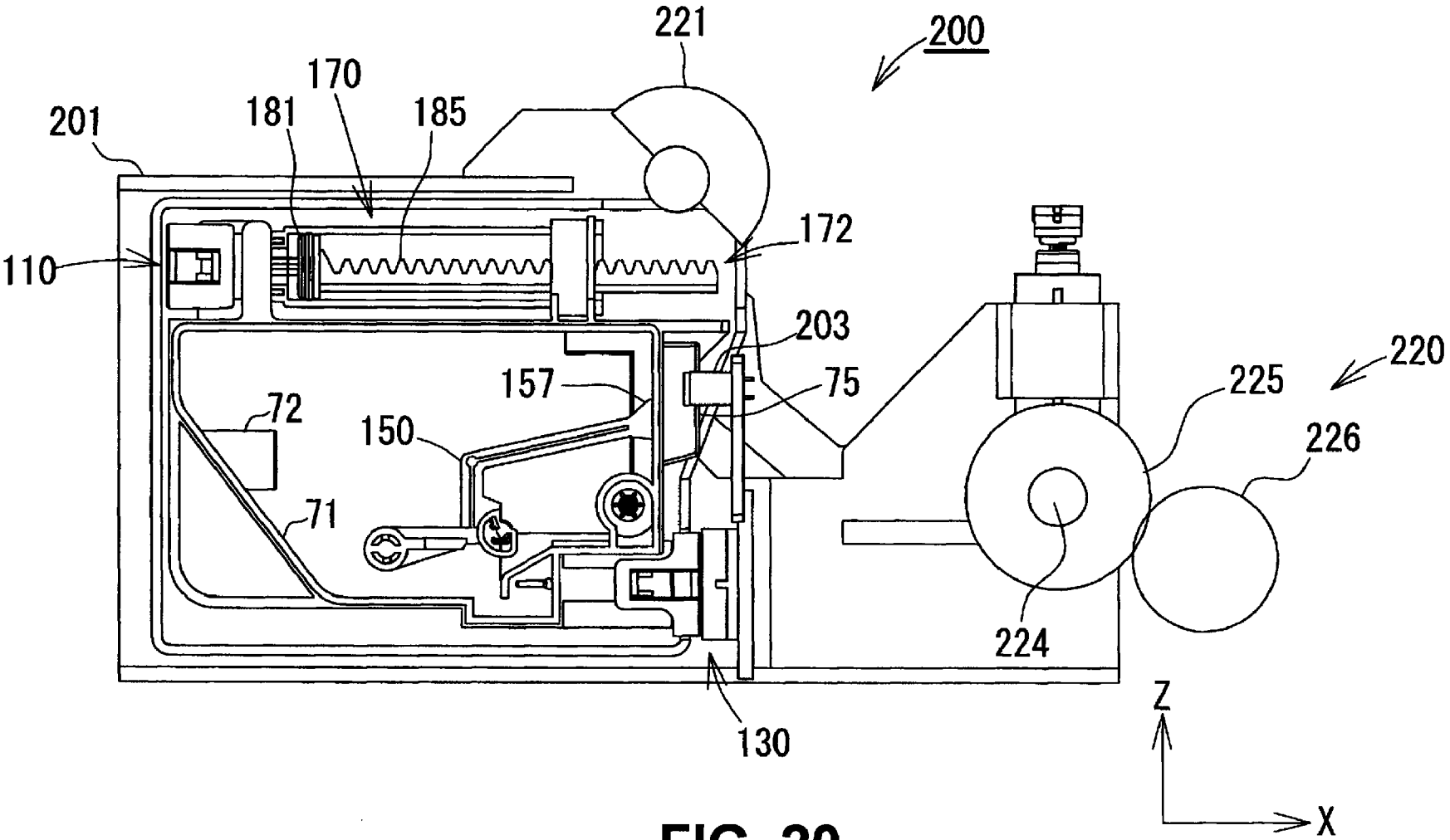
FIG. 20 is a cross-sectional view of the cartridge mounting portion of FIG. 17 taken along a line XX-XX.

The diameter of each of openings 244 is less than the diameter of an opening 149A of an ink supply tube 149, as shown in FIG. 16. The diameter of each of openings 244 may between 0.30 mm and 0.55 mm. When ink passes through openings 244, air bubbles contained in ink which are larger than the openings 244 may be divided by openings 244 into minute air bubbles having substantially the same diameter as that of openings 244.

Referring to FIG. 7, when air is supplied into ink chamber 73 by pump 170 while opening 87 is open, the pressure in ink chamber 73 increases until it is greater than the pressure in valve accommodating chamber 88, at which time opening 89 is opened by check valve 95 and opening 106 is closed by check valve 93. When this occurs, ink stored in ink chamber 73 may flow into valve accommodating chamber 88 via flow path 91, and flow out of main ink tank 70 via opening 87. In contrast, when air is drawn from ink chamber 73 by pump 170, the pressure in ink chamber 73 decreases until it is less than the pressure in valve accommodating chamber 88, at which time opening 89 is closed by check valve 95 and opening 106 is opened by check valve 93. When this occurs, ink may flow from flexible tube 32 into valve accommodating chamber 88, and then into ink chamber 73 via flow path 92.

In this embodiment, when ink flows into valve accommodating chamber 88 via opening 87, ink may flow from valve accommodating chamber 88 to ink chamber 73 via flow path 92. When ink flows out to the exterior of main ink tank 70 via opening 87, ink may flow from ink chamber 73 to the exterior of main ink tank 70 via flow path 91. Because check valve 93 is positioned in flow path 92 and check valve 95 is positioned in flow path 91, a circulating flow path along which ink circulates uni-directionally is formed in main ink tank 70, as shown in FIG. 7.

Referring to FIG. 7, sensor arm 150 may comprise at least one resin, e.g., a synthetic resin, and may be manufactured by injection molding. Sensor arm 150 may comprise a float portion 152, a connection portion 153 comprising shaft 158, and an arm portion 154. Float portion 152 may extend from connection portion 153 in a direction perpendicular to a direction in which shaft 158 extends. The specific gravity of float portion 152 may be less than the specific gravity of ink stored in ink chamber 73. Therefore, float portion 152 may be configured to float on ink if the movement of float portion 152 is not restricted. Float portion 152 may have a hollow space formed therein, or may comprise a solid material having a specific gravity which is less than the specific gravity of ink.

Arm portion 154 may comprise a first arm 155, a second arm 156, and light blocking portion 157. First arm 155 may extend from connection portion 153 in a direction perpendicular to the direction in which float portion 152 extends. Second arm 156 may extend from first arm 155 in a direction away from float portion 152. Light blocking portion 157 may be connected to an end of second arm 156.

Arm portion 154 may have less mass than float portion 152. As shown in FIG. 6, because the float portion 152 may be heavier than the arm portion 154, sensor arm 150 may be configured to pivot about shaft 158 in a counterclockwise direction 162, and at least a portion of light blocking member 157 may be configured to move out of inner space 76 of detection portion 75, when ink chamber 76 does not store ink therein. Float portion 152 may comprise a bottom end, and ink chamber 73 may comprise a bottom inner wall surface. When the bottom end of float portion 152 contacts the bottom inner wall surface of ink chamber 73, sensor arm 150 may be configured to stop pivoting, and light blocking portion 157 may be positioned, as shown in FIG. 6.

Referring to FIG. 11, when ink tank 76 is filled with the predetermined amount of ink, the entirety of sensor arm 150 may be submerged in ink. In this state, the buoyancy force acting on float portion 152 may be greater than the buoyancy force acting on arm portion 154, and the buoyancy force acting on float portion 152 may be sufficient enough to pivot sensor arm 150 around shaft 158 in a clockwise direction 163, as shown in FIG. 11, even when float portion 152 has a greater mass than the arm portion 154. Light blocking portion 157 may be configured to move into inner space 76 of detection portion 75, in accordance with the pivot of sensor arm 150. Sensor arm 150 may be configured to stop pivoting when light blocking portion 157 contacts support wall 74.

Figure 12:
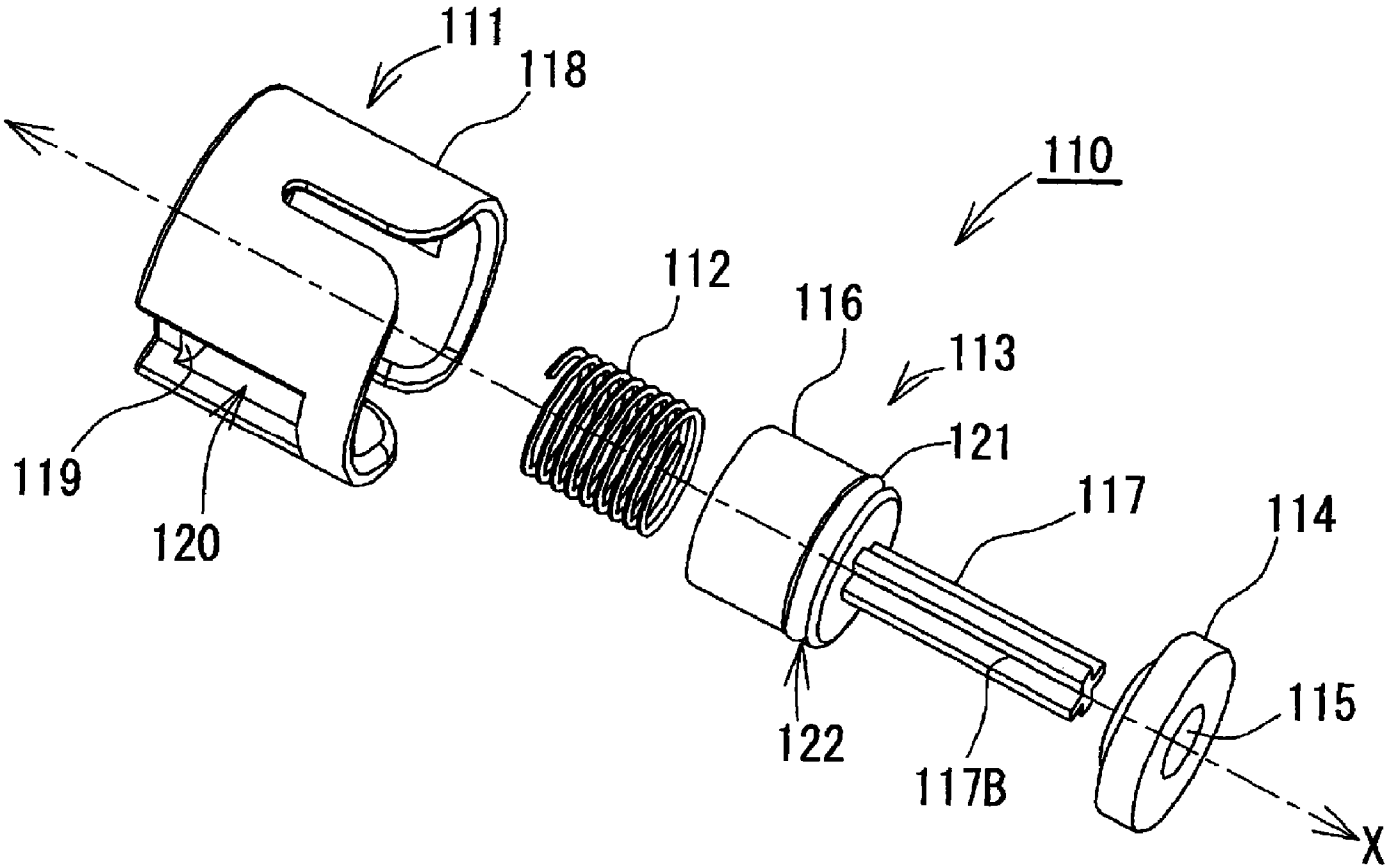
FIG. 12 is an exploded, perspective view of an air communication valve mechanism.
Figure 13A:
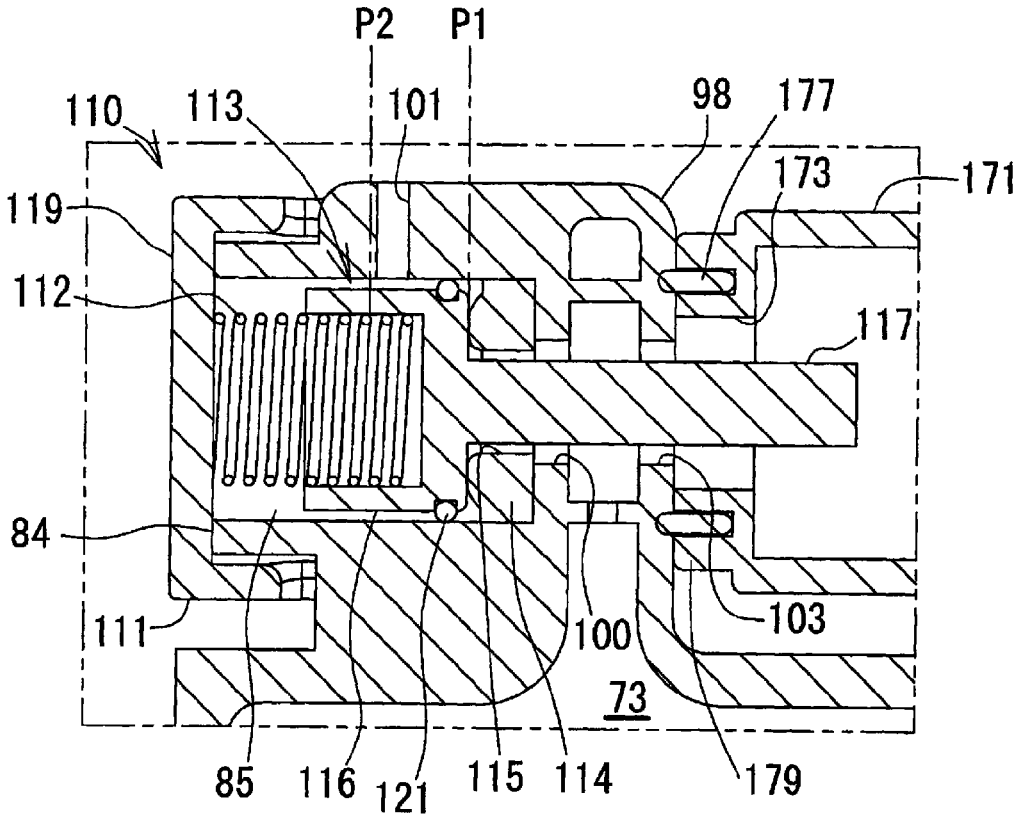
FIG. 13(A) is a partial, enlarged, cross-sectional view of the air communication valve mechanism of FIG. 12, in which a piston is positioned at a position P1.
Figure 13B:
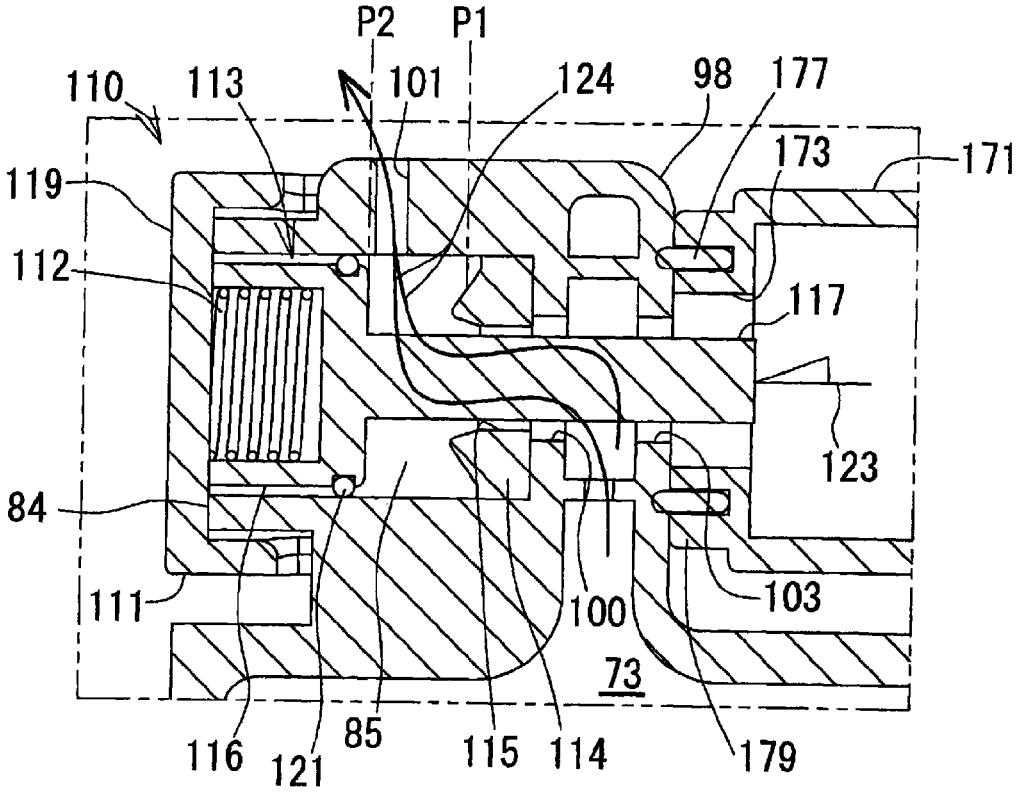
FIG. 13(B) is a partial, enlarged, cross-sectional view of the air communication valve mechanism of FIG. 12, in which the piston is positioned at a position P2.

Referring to FIGS. 12-13(B), air communication valve mechanism 110 may be configured to allow fluid communication between the atmosphere and air layer 83 via opening 101. Air communication valve mechanism 110 may comprise a cap 111, coil spring 112, valve 113, and valve seat 114. Cap 111, coil spring 112, valve 113, and valve seat 114 may be aligned in this order in the X-axis direction, as shown in FIG. 12. Coil spring 112, valve 113, and vale seat 114 may be accommodated in valve accommodating chamber 85, and cap 111 may be attached to the surrounding area of opening 84.

Coil spring 112 may bias valve 113 towards valve seat 114 in the X-axis direction. Coil spring 112 may comprise a metal material or a resin material. Coil spring 112 may be accommodated in valve accommodating chamber 85 in a compressed state, and may generate a force in a direction in which coil spring 112 expands. Coil spring 112 may be replaced with any urging member, e.g., a leaf spring, which urges valve 113 towards valve seat 114.

Cap 111 may comprise a circular end wall 119 and a cylindrical side wall 118 extending from the outer edge of end wall 119. End wall 119 may contact coil spring 112. Two slots 120 may be formed through side wall 118, and two ribs may be formed on the surrounding area of opening 84 and inserted into slots 120. Cap 111 may be attached to the surrounding area of opening 84.

Valve 113 may comprise piston 116, and rod 117 extending from piston 116. Piston 116 may contact coil spring 112. Piston 116 may be biased toward valve seat 114 in the X-axis direction. A circular groove 122 may be formed in the peripheral wall of piston 116, and an elastic O-ring 121 may be fitted in groove 122. The outer diameter of O-ring 121 may be greater than the outer diameter of the peripheral wall of piston 116. Valve 113 may be configured to slide inside valve accommodating chamber 85, with O-ring 121 contacting the wall surface of valve accommodating chamber 85, while preventing fluid communication between the coil spring 112 side of piston 116 and the rod 117 side of piston 116.

Valve seat 114 may be configured to contact piston 116, which is biased by coil spring 112 in the X-axis direction, and may be positioned at the end of valve accommodating chamber 85. Valve seat 114 may have an annular shape with an opening 115 formed through the center thereof. The center of opening 115 may be aligned with the center of opening 100, which is formed at the end of valve accommodating chamber 85. A portion of rod 117 may be positioned in opening 115. Valve seat 114 may comprise an elastic material, e.g. rubber, allowing valve seat 114 and piston 116 urged by coil spring 112 to contact tightly without a gap therebetween.

Referring to FIG. 13(A), when an external force is not applied to rod 117, valve 113 may be biased by coil spring 112, and may be positioned at a position P1, at which piston 116 contacts valve seat 114. Piston 116 and valve seat 114 may contact tightly, and valve seat 114 and the end of valve accommodating chamber 85 may contact tightly. Fluid communication between ink chamber 73 and valve accommodating chamber 85 via openings 100 and 115 may be prevented.

Referring to FIG. 13(B), when an external force, which may be greater than the biasing force of coil spring 112, is applied to rod 117 in a direction 123, valve 113 may move against the biasing force of coil spring 112 in direction 123, and piston 116 may separate from valve seat 114. Valve 113 may move to a position P2, at which position piston 116 may contact end wall 119 of cap 111. When this occurs, fluid communication between the atmosphere and ink chamber 73 may be established via opening 100, opening 115, valve accommodating chamber 85, and opening 101, as indicated by arrows 124. The external force may be applied by a piston 181 when a plunger 172 is pushed into an end of cylindrical tube 171, and piston 181 may push rod 117, as described below.

Figure 14:
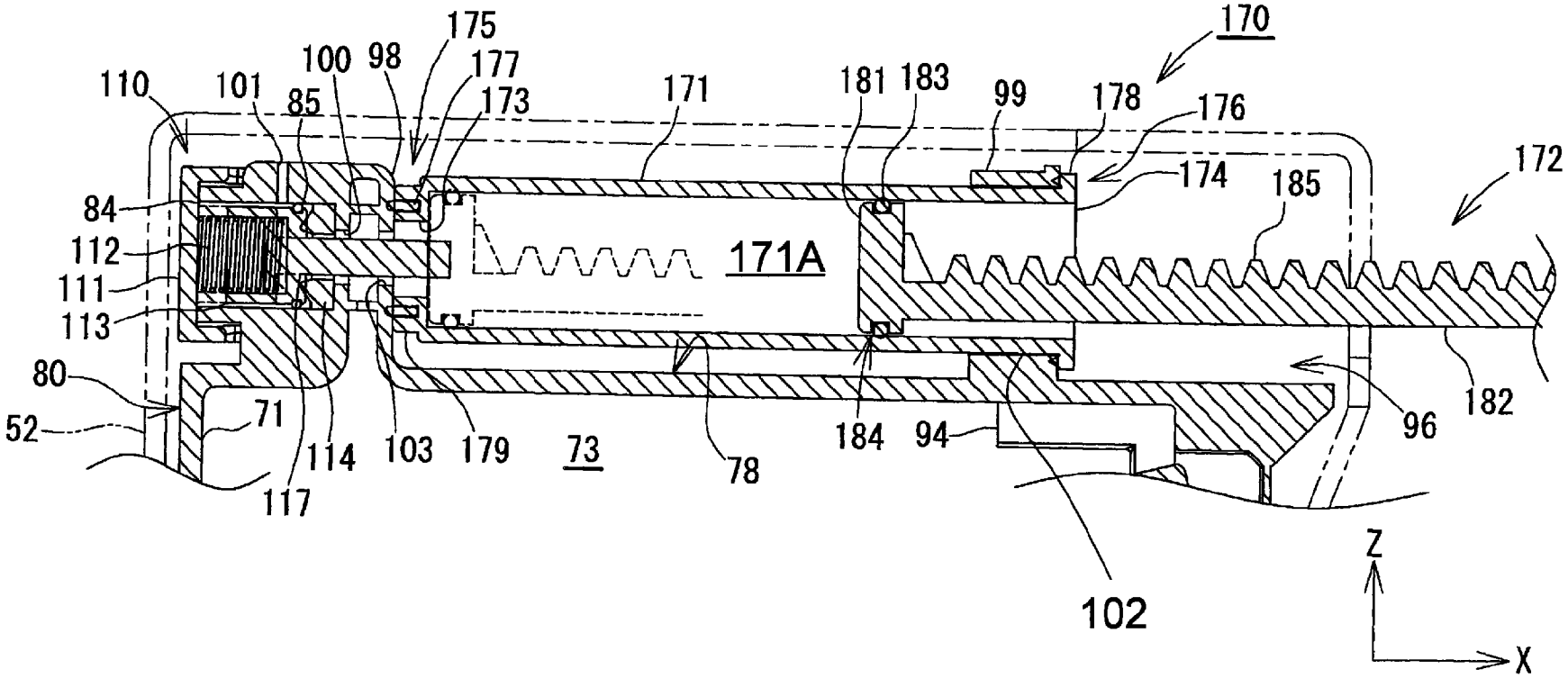
FIG. 14 is a partial, enlarged, cross-sectional view of a pump.

Referring to FIG. 14, pump 170 may be configured to selectively supply air to air layer 83 formed in ink chamber 73, and to draw air from air layer 83. When air is supplied to air layer 83, the air pressure of air layer 83 may increase, which may cause ink stored in ink chamber 73 to flow out of ink chamber 73. As a result, the volume of air layer 83 may increase. When air is drawn from air layer 83, the air pressure of air layer 83 decreases, which may cause ink to flow into ink chamber 73. As a result, the volume of air layer 83 may decrease.

Pump 170 may comprise cylindrical tube 171 and plunger 172, each of which may comprise at least one synthetic resin, and may be manufactured by injection molding.

Cylindrical tube 171 may be attached to upper face 78 of main ink tank 70. Cylindrical tube 171 may have a central axis extending between front end 176 and rear end 175, and the central axis of cylindrical tube 171 may be parallel with the X-axis direction. Cylindrical tube 171 may have an opening 174 at front end 176 thereof adjacent to front face 79 of main ink tank 70. Plunger 172 may be inserted into inner space 171A of cylindrical tube 171 through opening 174. Cylindrical tube 171 may comprise an end wall 179 at rear end 175 thereof, which contacts pump seat 98. An opening 173 may be formed through end wall 179. Air in inner space 171A may flow into and out of ink chamber 73 via opening 173.

An annular attachment member 177 may be provided at rear end 175. A portion of attachment member 177 may be buried in end wall 179, and the other portion of attachment member 177 may extend from rear end 175 in the axial direction of cylindrical tube 171. Pump seat 98 may have an annular groove formed therein, and the extending portion of attachment member 177 may be fitted in the groove of pump seat 98. Rear end 175 of cylindrical tube 171 may thus be attached to pump seat 98. Attachment member 177 may be coated with a rubber material, and therefore, attachment member 177 and pump seat 98 may contact tightly without a gap therebetween. As a result, an air path between inner space 171A of cylindrical tube 171 and ink chamber 73 may be air-tightly sealed, such that air may not leak from the air path and air may not enter into the air path from the atmosphere.

Cylindrical tube 171 may comprise a flange 178 at front end 176, and flange 178 may extend from cylindrical tube 171 in the radial direction of cylindrical tube 171. Rear end 175 of cylindrical tube 171 may be inserted into opening 102 of pump seat 99, and when front end 176 of cylindrical tube 171 reaches pump seat 99, flange 178 may contact the surrounding area of opening 102.

Plunger 172 may comprise piston 181 and rod 182, which may be integrally formed. A circular groove 184 may be formed in the peripheral wall of piston 181, and an elastic O-ring 183 may be fitted in groove 184. The outer diameter of O-ring 184 may be greater than the outer diameter of the peripheral surface of piston 181. Piston 181 may be configured to slide within inner space 171A with O-ring 184 contacting the inner surface of cylindrical tube 171, while preventing air communication between the front-end 176 side of piston 181 and the rear-end 175 side of piston 181. In another embodiment, O-ring 183 may be omitted, and the peripheral surface of piston 181 may be coated with an elastic material, and piston 181 may be configured to slide on the inner surface of cylindrical tube 171 with the peripheral surface of piston 181 contacting the inner surface of cylindrical tube 171 while preventing fluid communication between the front-end 176 side of piston 181 and the rear-end 175 side of piston 181.

A rack gear 185 may be formed on the upper surface of rod 182. Rack gear 185 may be configured to engage a pinion gear 221. A driving force thus may be transferred to piston 181 via rod 182, to slide piston 181 in the axial direction of cylindrical tube 171. When piston 181 slides towards rear face 80 of main ink tank 70 in the X-axis direction, the volume of inner space 171A of cylindrical tube 171 may decrease. Air corresponding to the decrease of the volume of inner space 171A may be supplied to air layer 83 formed in ink chamber 73 via openings 173 and 103. When piston 181 slides towards front face 79 of main ink tank 70 in the X-axis direction, the volume of inner space 171A of cylindrical tube 171 may increase. Air may be drawn from air layer 83 into inner space 171A via openings 173 and 103.

The capacity of pump 170 may be greater than or equal to the capacity of sub ink tank 21 and the capacity of tube 32. The capacity of pump 170 may be determined based on the cross sectional area of inner space 171A of cylindrical tube 171 and the moving range of piston 181. Cylindrical tube 171 may have a cross sectional area and a length which allows the capacity of pump 170 to be greater than or equal to the capacity of sub ink tank 21 and the capacity of tube 32. The moving range of piston 181 may be predetermined by a driving mechanism 220. Pump 170 may be configured to supply a predetermined amount of air into ink chamber 73, and may draw the predetermined amount of air from ink chamber 73.

Figure 15:
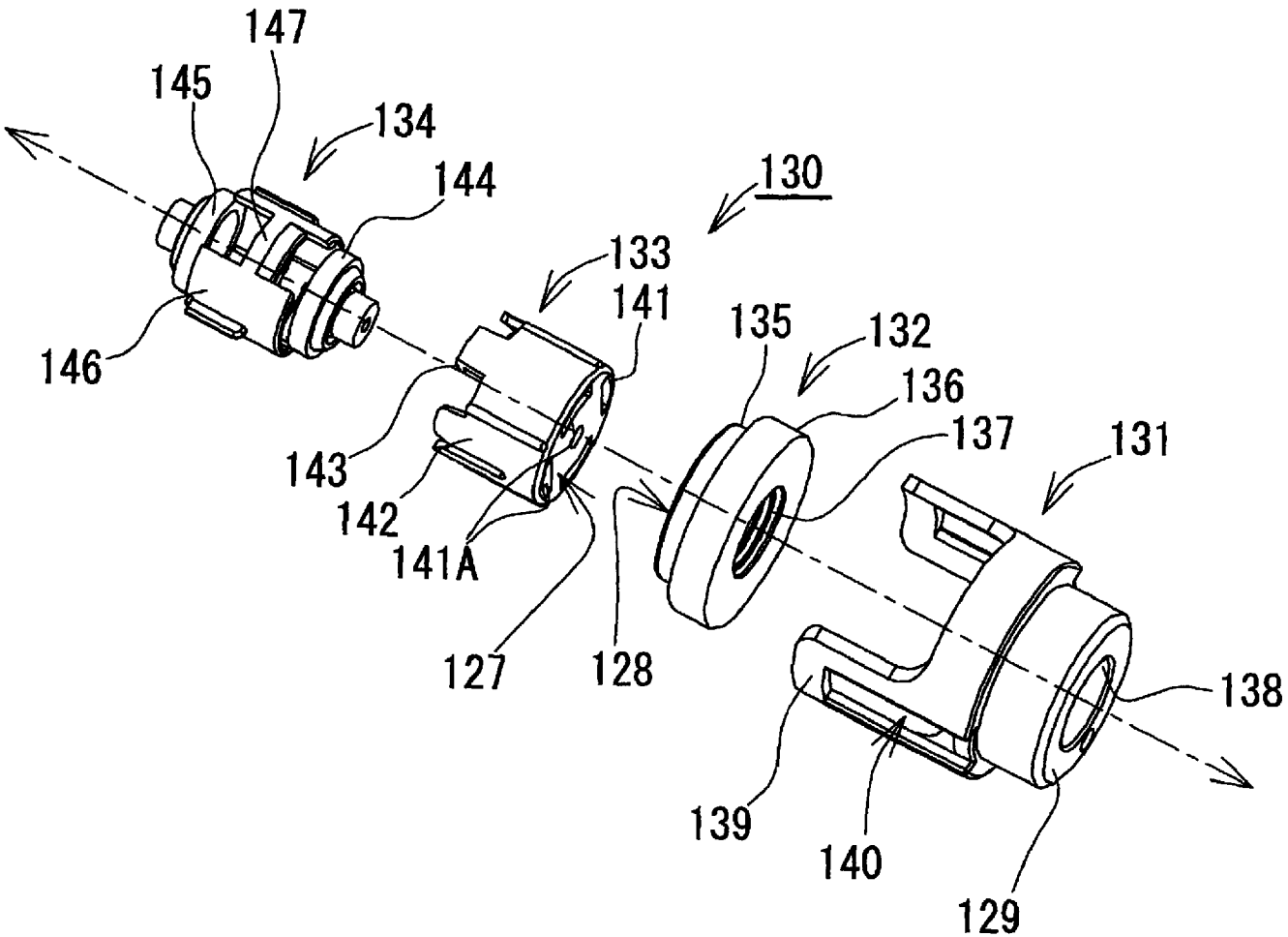
FIG. 15 is an exploded, perspective view of an ink supply valve mechanism.

Referring to FIGS. 15 and 16, ink supply valve mechanism 130 may be configured to supply ink in ink chamber 73 to the exterior of ink cartridge 50, and may be connected to tube 32. Ink supply valve mechanism 130 may comprise a cap 131, a valve seat 132, valve 133, and spring unit 134. Cap 131, valve seat 132, valve 133, and spring unit 134 may be aligned in this order in the X-axis direction. Valve 133 and spring unit 134 may be accommodated within valve accommodating chamber 88. A portion of valve seat 132 may be fitted in opening 87 from the exterior of valve accommodating chamber 88. Cap 131 may be attached to the surrounding area of opening 87 via valve seat 132, which may comprise an elastic synthetic resin. Valve seat 132 may have an annular shape with an opening 137 formed through the center thereof.

Valve seat 132 may comprise a first cylindrical portion 135 and a second cylindrical portion 136. First cylindrical portion 135 may be fitted in opening 87 and second cylindrical portion 136 may contact the surrounding portion of opening 87. A rigid ink supply tube 149 may be connected to an end of tube 32. Ink supply tube 149 may be configured to be in fluid communication with valve accommodating chamber 88 via opening 137 when ink cartridge 50 is mounted to cartridge mounting portion 200. More specifically, ink supply tube 149 may be configured to be inserted through opening 137 when ink cartridge 50 is mounted to cartridge mounting portion 200. The diameter of opening 137 may be slightly smaller than the outer diameter of ink supply tube 149. Consequently, when ink supply tube 149 is inserted through opening 137, the outer surface of ink supply tube 149 may press the inner surface of valve seat 132, which defines opening 137, and the outer surface of ink supply tube 149 and the inner surface of valve seat 132 may contact tightly, which may prevent ink leakage between ink supply tube 149 and valve seat 132.

Cap 131 may comprise a circular end wall 129 and a side wall 139 extending from the outer edge of end wall 129. End wall 129 may have an opening 138 formed therethrough. Two slots 140 may be formed through side wall 139. Two ribs are formed on the surrounding area of opening 87, and the ribs may be inserted into slots 140. Cap 131 may be attached to the surrounding area of opening 87.

Spring unit 134 may be configured to bias valve 133 towards valve seat 132 in the X-axis direction. Spring unit 134 may comprise a first spring 144, a second spring 145, and a slider 146. Each of first spring 144 and second spring 145 may comprise an elastic resin material, and may have an indented, rounded shape, e.g., a bowl shape, or a hollow circular conic shape. When a load is applied to first spring 144 or second spring 145, the side surface thereof may be elastically deformed.

First spring 144 and second spring 145 may have an opening 144A and an opening 145A formed therethrough, respectively. Ink may flow through the interior of first spring 144 and second spring 145 via openings 144A and 145A, respectively, as indicated by arrows 16 in FIG. 16. Slider 146 may comprise two accommodating chambers which accommodate first spring 144 and second spring 145 therein, respectively.

Spring unit 134 may be accommodated in valve accommodating chamber 88 in a compressed state, and may generate a force in a direction which causes spring unit 134 to expand. End wall 105 may contact and support spring unit 134.

Slider 146 may comprise ribs 147 for coupling valve 133 and spring unit 134. Valve 133 may comprise claws 143, which may be configured to engage ribs 147. Any member may be used instead of spring unit 134, as long as the member urges valve 133 towards valve seat 132.

Valve 133 may comprise a circular end wall 141 and a cylindrical side wall 142 extending from the outer edge of end wall 141. End wall 141 may have a plurality of openings 141A formed therethrough, and openings 141A may be aligned in the circumferential direction of end wall 141. End wall 141 contacts first spring 144. Side wall 142 may comprise claws 143. Valve 133 and spring unit 134 may be coupled by the engagement between claws 143 and ribs 147. Valve accommodating chamber 88 may comprise a cylindrical wall surface extending from opening 87 to the end of the valve accommodating chamber 88. Valve 133 may be configured to slide within valve accommodating chamber 88 in the X-axis direction, with a gap 148 between side wall 142 and the wall surface of valve accommodating chamber 85, and ink may flow through gap 148.

When ink supply tube 149 is inserted into valve accommodating chamber 88 via openings 138 and 137, an end of ink supply tube 149 may contact end wall 141 of valve 133 and press valve 133 against the biasing force of spring unit 134. Valve 133 may move toward ink chamber 73, and end wall 141 may separate from valve seat 132. Tube 149 may have opening 149A formed therethrough, adjacent to the end of tube 149. When end wall 141 separates from valve seat 132, fluid communication between valve accommodating chamber 88 and the interior of tube 149, via opening 149A, may be established.

When ink is supplied from ink chamber 73 to sub ink tank 21, ink may enter into valve accommodating chamber 88 via check valve 95, and then the ink may flow through gap 148 or flow through spring unit 134 and openings 141A, as indicated by arrows 164 in FIG. 16. When ink is drawn from sub ink tank 21 to ink chamber 73, ink may flow into valve accommodating chamber 88 via opening 149A, and then the ink may flow to air layer 83 via buffer chamber 90 and check valve 93.

Referring to FIGS. 17-20, cartridge mounting portion 200 may be configured to receive at least one ink cartridge 50. In an embodiment, cartridge mounting portion 200 may receive a plurality of, e.g., five, ink cartridges 50 storing cyan ink, magenta ink, yellow ink, dye-based black ink, and pigment-based black ink, respectively. Cartridge mounting portion 200 may comprise a cartridge case 201 having an opening 202 on one side, and a closed end opposite the opening 202. Ink cartridge 50 may be inserted into cartridge case 201 through opening 202. When ink cartridge 50 is inserted into cartridge case 201 and is pressed in the X-axis direction, ink supply tube 149, provided at the closed end of cartridge case 201, may enter into ink supply valve mechanism 130. After ink stored in ink chamber 73 is consumed, ink cartridge 50 may be removed from cartridge case 201 and replaced with a new ink cartridge 50.

At least one optical sensor 203, e.g., a photo interrupter, may be positioned at the closed end of cartridge 201. Optical sensor 203 may comprise a light emitting portion and a light receiving portion. Optical sensor 203 may be configured to output a predetermined signal to the main controller of inkjet recording device 10 based on the intensity of light received by the light receiving portion. A plurality of, e.g., five, optical sensors 203 may be provided for the plurality of, e.g., five, ink cartridges 50, respectively. Optical sensor 203 may be positioned, such that detection portion 75 is positioned between the light emitting portion and the light receiving portion when the ink cartridge 50 is mounted to cartridge mounting portion 200.

When light blocking portion 157 is positioned within detection portion 75, light blocking portion 157 may block light emitted from the light emitting portion. When light blocking portion 157 is positioned outside of detection portion 75, light emitted from the light emitting portion may reach the light receiving portion unhindered. Based on the intensity of light received by the light receiving portion, the amount of ink remaining in ink cartridge 50 may be determined.

Driving mechanism 220 may be positioned behind cartridge mounting portion 200. Driving mechanism 200 may comprise at least one pinion gear 221, a shaft 222, a link rod 223, a shaft 224, a first gear 225, and a second gear 226.

A plurality of, e.g., five, pinion gears 221 may be provided, corresponding to the plurality of, e.g., five, ink cartridges 50. Pinion gear 221 may be configured to engage rack gear 185 when ink cartridge 50 is mounted to cartridge mounting portion 200. Pinion gear 221 may have a semi-circular shape, and the teeth may be formed on the arc portion of pinion gear 221.

A plurality of, e.g., five, pinion gears 221 may be fixed to shaft 222. When shaft 222 rotates, all of the pinion gears 221 may rotate in the same direction in which shaft 222 rotates, and at the same speed at which shaft 222 rotates. Link rod 223 may be coupled to one end of shaft 222 at one end thereof, and may be coupled to shaft 224 at the other end thereof. First gear 225 may be fixed to shaft 224, and second gear 226 may engage first gear 225.

Second gear 226 may be coupled to a driving source, e.g., a motor. Paper feed device 12 and convey device 13 may be coupled to the same driving source, which may be controlled by the main controller of inkjet recording device 10.

When a driving force is transferred to second gear 226 from the driving source, the driving force also may be transferred to rack gear 185 via first gear 225, shaft 224, link rod 223, shaft 222, and pinion gear 221. Thus, piston 181 may be configured to slide back and forth within cylindrical tube 171.

Figure 21A:
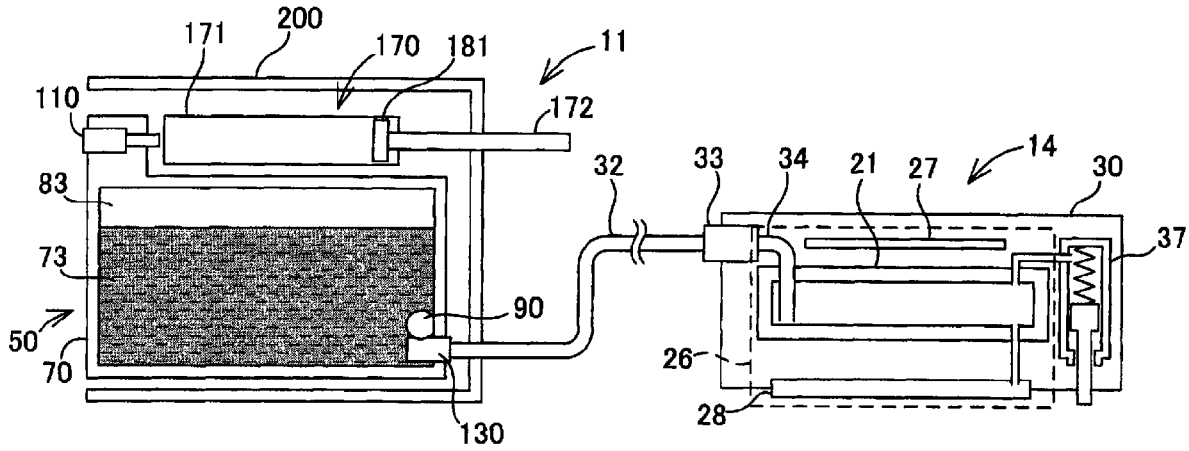
FIGS. 21(A)-(C) are schematic diagrams of an ink supply operation.
Figure 21B:
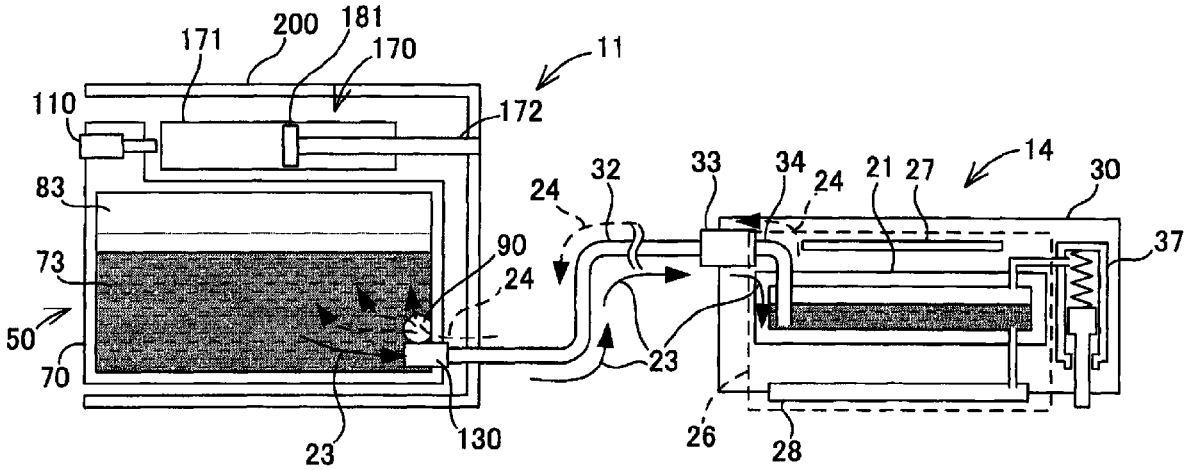
Figure 21C:
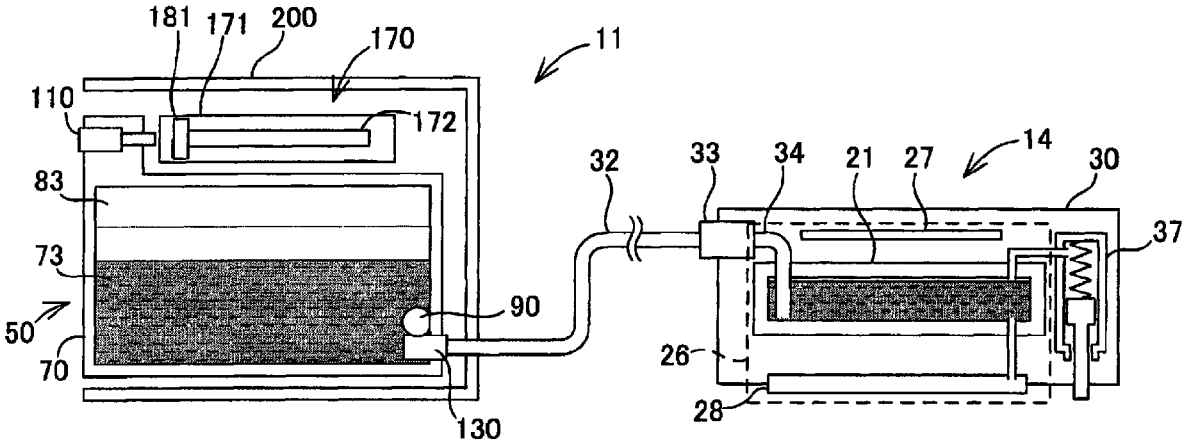

Referring to FIGS. 21(A)-21(C), an ink supply process from main ink tank 70 to sub ink tank 21 by an ink supply system 11, according to an embodiment of the present invention, is depicted. During the ink supply process, opening 42 formed at cylinder 39 of valve mechanism 37 may be opened as described above.

Referring to FIG. 21(A), when plunger 172 is moved toward rear face 80 of main ink tank 70 from a state in which plunger 172 is positioned as far out of cylindrical tube 171 as its range of motion may allow, air in cylindrical tube 171 may be supplied to air layer 83 formed in ink chamber 73, via openings 173 and 103. As a result, the pressure in ink chamber 73 may increase. Referring to FIG. 21(B), when the pressure in ink chamber 73 increases and becomes greater than the pressure in valve accommodating chamber 88, check valve 95 may open opening 89, and ink stored in ink chamber 73 may flow into valve accommodating chamber 88, via opening 89 and openings 254 of valve seat 251. Ink then may flow into tube 32 and may be supplied to sub ink tank 21, as indicated by arrows 23. More specifically, ink may flow from ink chamber 73 via openings 254 of valve seat 251 into valve accommodating chamber 88. Ink then passes through and around spring unit 134, and flows into the interior of tube 32 via opening 149A of ink supply tube 149. Ink then flows into sub ink tank 21 via the interior of tube 32. As a result, the volume of air layer 83 may increase. Referring to FIG. 21(C), when plunger 172 is moved to the end of cylindrical tube 171, sub ink tank 21 and tube 32 may be filled with ink.

Referring to FIG. 21(C), when plunger 172 is moved back towards front face 79 of main ink tank 70 from a state in which plunger 172 is pushed into cylindrical tube 171 as far as plunger 172's range of motion may allow, air may be drawn from air layer 83 into cylindrical tube 171 via openings 103 and 173. As a result, the pressure in ink chamber 73 may decrease. Referring to FIG. 21(B), when the pressure in ink chamber 73 decreases and becomes less than the pressure in valve accommodating chamber 88, check valve 93 may open opening 106, and ink stored in sub ink tank 21 and tube 32 may flow into main ink tank 70, as indicated by arrows 24. More specifically, ink in valve accommodating chamber 88 may flow into ink chamber 73 via opening 104 and openings 244 of valve seat 241. This may cause ink in sub ink tank 21 to flow into valve accommodating chamber 88 via tube 32, which may result in a decrease in the volume of air layer 83.

Referring again to FIG. 21(A), when plunger 172 is positioned as far out of cylindrical tube 171 as its range of motion may allow, ink in tube 32 and sub ink tank 21 may be completely drawn into main ink tank 70. During the process in which ink is drawn into ink chamber 73 of main ink tank 70, air bubbles trapped in tube 32 or sub ink tank 21 also may be drawn into ink chamber 73 via ink path 92.

When the ink passes through openings 244, air bubbles contained in ink may be divided by openings 244 into minute air bubbles having substantially the same diameter as openings 244. The minute air bubbles may enter the ink chamber 73. The minute air bubbles in ink chamber 73 may rise toward air layer 83 by buoyancy acting thereon. The minute air bubbles may rise while capturing minute impurities, such as minute dusts, which are present around the minute air bubbles. When the minute air bubbles reach air layer 83, the minute air bubbles may move to the inner wall surface of the main ink tank 70 and may adhere to the inner wall surface. When this occurs, the impurities captured by the minute air bubbles also may adhere to the inner wall surface. Even when the minute air bubbles adhering to the inner wall surface of main ink tank 70 are broken and disappear, the impurities may continue to adhere to the inner wall surface. Accordingly, the impurities contained in ink may be separated from ink and collected at positions adjacent to air layer 83. Subsequently, as described above, by supplying ink from main ink tank 70 to sub ink tank 21, ink free from impurities may be supplied to the sub ink tank 21 via the tube 32.

In this embodiment, because the air bubbles contained in ink are divided into the minute air bubbles when the ink flows into the ink chamber 73 via flow path 92, the minute impurities contained in ink stored in ink chamber 73 may be captured by the minute air bubbles and collected at positions adjacent to air layer 83. Consequently, ink free from the impurities may be supplied to recording head 26, and consequently, clogging of nozzles 28 of recording head 26 or ink ejection failure may be prevented.

Because of check valves 93 and 95, when ink flows into main ink tank 70, ink flows into ink chamber 73 via flow path 92, and when ink flows out of main ink tank 70, ink flows out via flow path 91. Therefore, even when ink flows out of main ink tank 70 immediately after ink flows into main ink tank 70, the minute air bubbles drifting in ink chamber 73 may not be supplied to recording head 26. When ink flows from main ink tank 70 to recording head 26, ink passes through openings 254, which have less flow resistance than that of openings 244, and therefore, ink may flow smoothly.

In this embodiment, minute openings 244 are formed through valve seat 241 of check valve 93. Nevertheless, openings 244 alternatively may be formed through end wall 107, and a valve may selectively open and close openings 244 formed through end wall 107.

In this embodiment, pump 170 is mounted on the ink cartridges 50. In another embodiment, pump 170 may be mounted on cartridge mounting unit 200, or pump 170 may be mounted on the carriage 30. Pump 170 also may be positioned at a position other than cartridge mounting unit 200 and carriage 30. Another type of pump, such as a tube pump, may be used instead of pump 170.

While the invention has been described in connection with various exemplary structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. An ink cartridge comprising:

an ink tank comprising:

an ink chamber formed in an interior of the ink tank;

a first wall separating the interior of the ink tank and an exterior of the ink tank, wherein the first wall has a first opening formed therethrough, a partition wall connected to the first wall, wherein the partition wall defines a first chamber formed therein, and the first chamber is continuous with the first opening; and a divider, wherein the first chamber and the ink chamber are in fluid communication via the divider, and when ink flows through the divider from the first chamber to the ink chamber, the divider is configured to divide a first air bubble contained in the ink into a plurality of second air bubbles, wherein a size of the first air bubble is greater than a size of each of the plurality of second air bubbles; and a pump configured to selectively force ink into and out of the interior of the ink tank.

2. The ink cartridge of claim 1, wherein the divider comprises a second wall positioned at the partition wall, wherein the second wall has at least one second opening formed therethrough, and a diameter of the at least one second opening is less than a diameter of the first opening.

3. The ink cartridge of claim 2, further comprising a first check valve configured to selectively allow ink to flow from the first chamber to the ink chamber through the at least one second opening, and to prevent ink from flowing from the ink chamber to the first chamber through the at least one second opening.

4. The ink cartridge of claim 3, further comprising:

a third wall positioned at the partition wall, wherein the third wall has at least one third opening formed therethrough, and a diameter of the at least one third opening is greater than the diameter of the at least one second opening; and a second check valve configured to selectively allow ink to flow from the ink chamber to the first chamber through the at least one third opening, and to prevent ink from flowing from the first chamber to the ink chamber through the at least one third opening.

5. The ink cartridge of claim 1, further comprising a valve mechanism positioned in the first chamber, wherein the valve mechanism is configured to selectively open and close the first opening.

6. The ink cartridge of claim 5, wherein the valve mechanism comprises:

a valve seat fitted in the first opening, wherein the valve seat has a valve seat opening formed therethrough;

a valve positioned in the first chamber, wherein the valve is configured to move in the first chamber to selectively be in contact with and separated from the valve seat; and a biasing member positioned in the first chamber, wherein the biasing member is configured to bias the valve toward the valve seat to a position in which the valve contacts the valve seat and closes the valve seat opening.

7. The ink cartridge of claim 1, wherein the pump is configured to selectively supply air to an air layer formed in the ink chamber and draw air from the air layer, wherein the air layer is in contact with ink in the ink chamber.

8. An ink supply system, comprising:

an ink tank comprising:

an ink chamber formed in an interior of the ink tank;

a first wall separating the interior of the ink tank and an exterior of the ink tank, wherein the first wall has a first opening formed therethrough, a partition wall connected to the first wall, wherein the partition wall defines a first chamber formed therein, and the first chamber is continuous with the first opening; and a divider, wherein the first chamber and the ink chamber are in fluid communication via the divider, and when ink flows through the divider from the first chamber to the ink chamber, the divider is configured to divide a first air bubble contained in the ink into a plurality of second air bubbles, wherein a size of the first air bubble is greater than a size of each of the plurality of second air bubbles; and a pump configured to selectively force ink into and out of the interior of the ink tank; and a tube configured to be in fluid communication with the first chamber via the first opening.

9. The ink supply system of claim 8, wherein the tube is configured to be inserted into the first opening, and the tube has a tube opening formed therethrough, wherein the divider comprises a second wall positioned at the partition wall, wherein the second wall has at least one second opening formed therethrough, and a diameter of the at least one second opening is less than each of a diameter of the first opening and a diameter of the tube opening.

10. The ink supply system of claim 9, further comprising a first check valve configured to selectively allow ink to flow from the first chamber to the ink chamber through the at least one second opening, and to prevent ink from flowing from the ink chamber to the first chamber through the at least one second opening.

11. The ink supply system of claim 10, further comprising:

a third wall positioned at the partition wall, wherein the third wall has at least one third opening formed therethrough, and a diameter of the at least one third opening is greater than the diameter of the at least one second opening; and a second check valve configured to selectively allow ink to flow from the ink chamber to the first chamber through the at least one third opening, and to prevent ink from flowing from the first chamber to the ink chamber through the at least one third opening.

12. The ink supply system of claim 8, further comprising a valve mechanism positioned in the first chamber, wherein the valve mechanism is configured to selectively open and close the first opening.

13. The ink supply system of claim 12, wherein the valve mechanism comprises:

a valve seat fitted in the first opening, wherein the valve seat has a valve seat opening formed therethrough;

a valve positioned in the first chamber, wherein the valve is configured to move in the first chamber to selectively be in contact with and separated from the valve seat; and a biasing member positioned in the first chamber, biasing member is configured to bias the valve toward the valve seat in a direction in which the valve contacts the valve seat and closes the valve seat opening.

14. The ink supply system of claim 8, wherein the pump is configured to selectively supply air to an air layer formed in the ink chamber and to draw air from the air layer, wherein the air layer is in contact with ink in the ink chamber.

* * * * *